US006889521B2

(12) United States Patent
Seno et al.

(10) Patent No.: US 6,889,521 B2
(45) Date of Patent: May 10, 2005

(54) HEAT EXCHANGER WITH RECEIVER TANK, AND REFRIGERATION SYSTEM

(75) Inventors: Yoshihiko Seno, Tokyo (JP); Osamu Kamoshida, Tokyo (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 10/469,383

(22) PCT Filed: Mar. 1, 2002

(86) PCT No.: PCT/JP02/01909

§ 371 (c)(1),
(2), (4) Date: Feb. 19, 2004

(87) PCT Pub. No.: WO02/070206

PCT Pub. Date: Sep. 12, 2002

(65) Prior Publication Data

US 2004/0182553 A1 Sep. 23, 2004

Related U.S. Application Data

(60) Provisional application No. 60/302,646, filed on Jul. 5, 2001, provisional application No. 60/302,657, filed on Jul. 5, 2001, provisional application No. 60/302,690, filed on Jul. 5, 2001, and provisional application No. 60/302,708, filed on Jul. 5, 2001.

(30) Foreign Application Priority Data

| | | |
|---|---|---|
| Mar. 2, 2001 | (JP) | 2001-057829 |
| Mar. 2, 2001 | (JP) | 2001-057831 |
| Mar. 2, 2001 | (JP) | 2001-057849 |
| Mar. 2, 2001 | (JP) | 2001-057852 |

(51) Int. Cl.[7] ..... F25B 39/04
(52) U.S. Cl. ..... 62/506; 62/509
(58) Field of Search ..... 62/474, 503, 506, 62/509

(56) References Cited

U.S. PATENT DOCUMENTS 6,330,810 B1 * 12/2001 Yamazaki et al. ..... 62/509
6,494,059 B2 * 12/2002 Yamazaki et al. ..... 62/509

FOREIGN PATENT DOCUMENTS

| | | |
|---|---|---|
| JP | 11-270927 | 10/1999 |
| JP | 11-316064 | 11/1999 |

* cited by examiner

*Primary Examiner*—Melvin Jones
(74) *Attorney, Agent, or Firm*—Oblon, Spivak, McClelland, Maier & Neustadt, P.C.

(57) ABSTRACT

A heat exchanger with a receiver tank is provided with a multi-flow type heat-exchange body (10), a receiver tank (3), a block flange (4) having a side surface connected to the periphery of a condensing portion outlet of the heat exchanger body (10) and an upper en to which a lower end of the receiver tank (3) is attached and a bracket (6) for supporting the upper part of the receiver tank (3) to the heat exchanger body (10). A flange-shaped pressing stepped portion (31*a*) is formed on the upper periphery of the tank main body (31) of the receiver tank (3). The bracket (6) is provided with a joint portion (61*b*) to be secured to the peripheral surface of one of headers (11) and embracing portions (61*a*) and (62*a*) that surround the periphery of the tank main body (31) and are engaged with the upper side of the pressing stepped portion (31*a*) to downwardly press the receiver tank (3). With this heat exchanger, stable refrigeration performance can be obtained and that the assembling operation can be performed easily.

54 Claims, 17 Drawing Sheets

HEAT EXCHANGER WITH RECEIVER TANK, AND REFRIGERATION SYSTEM

CROSS REFERENCE TO RELATED APPLICATIONS

This application is an application filed under 35 U.S.C. §111(a) claiming the benefit pursuant to 35 U.S.C. §119(e)(1) of the filing date of Provisional Applications Nos. 60/302,646, 60/302,657, 60/302,690 and 60/302,708 each filed on Jul. 5, 2001 pursuant to 35 U.S.C. §111(b).

TECHNICAL FIELD

The present invention relates to a heat exchanger with a receiver tank suitably used for car air-conditioning apparatuses, and also relates to a refrigeration system using the heat exchanger.

BACKGROUND ART

Recent years, in a condensing process of a refrigerant in a refrigeration cycle for use in car air-conditioning systems or the like, the following technique has been proposed. In the technique, after increasing the heat release of the refrigerant by subcooling the condensed refrigerant to lower the temperature than the condensing temperature thereof by a few degrees to obtain a subcooled refrigerant, the subcooled refrigerant is introduced to decompressing means and an evaporator to enhance the refrigeration performance.

In this proposed technique, a heat exchanger with a receiver tank (subcool system condenser) in which a receiver tank is attached to a heat exchanger integrally provided with a condensing portion and a subcooling portion has been developed.

As shown in FIG. 24, in this heat exchanger with a receiver tank, a heat exchanger body 100 includes a pair of headers 101 and 101 and a plurality of heat exchanging tubes disposed in parallel with each other with opposite ends communicated with the headers 101 and 101. The plurality of heat exchanging tubes is grouped into a plurality of passes P1 to P5 by partitions 102 provided in the headers 101 and 101. The passes P1 to P3 constitute a condensing portion 110, and the passes P4 and P5 constitute a subcooling portion 120 independent from the condensing portion 110.

A condensing portion inlet 111 and a condensing portion outlet 112 are provided to the upper and lower portions of the headers 101 and 101 constituting the condensing portion 110, respectively. On the other hand, a subcooling portion inlet 121 and a subcooling portion outlet 122 are formed in the upper and lower portions of one of the headers 101, respectively.

The receiver tank 130 disposed along one of the headers 101 has a receiver tank inlet 131 and a receiver tank outlet 132 communicated with the condensing portion outlet 112 and the subcooling portion inlet 121, respectively.

In this heat exchanger with a receiver tank, the gaseous refrigerant flowed into the condensing portion 110 via the condensing portion inlet 111 is condensed by exchanging heat with the ambient air while passing through each pass P1 to P3 constituting the condensing portion 110. Furthermore, the condensed refrigerant is introduced into the receiver tank 130 through the condensing portion outlet 112 and the receiver tank inlet 131 and once stored therein. Then, only the liquefied refrigerant is led to the subcooling portion 120 through the receiver tank outlet 132 and the subcooling portion inlet 121. The liquefied refrigerant flowed into the subcooling portion 120 is subcooled by the ambient air while passing through the fourth pass P4 and the fifth pass P5, and then flows out of the subcooling portion outlet 122.

In this receiver tank integrated type heat exchanger, as shown in FIG. 25, for example, the receiver tank 130 is usually connected to the heat exchanger body 100 via a joint member such as a block flange 140. That is, the flange 140 of the heat exchanger is integrally provided with a first block 151 joined to the condensing portion outlet 112 of one of the headers 101 of the heat exchanger body 100 and the second block 152 joined to the subcooling portion inlet 121. The first block 151 is provided with an inlet flow passage 141 having one end opened to the flange upper surface and the other end communicated with the condensing portion outlet 112. On the other hand, the second block 152 is provided with an outlet flow passage 142 having one end opened to the flange upper surface and the other end communicated with the subcooling portion inlet 121.

On the other hand, the receiver tank 130 is provided with a lower end closing member 136 having the receiver tank inlet 131 and the receiver tank outlet 132 each communicated with the inside of the receiver tank 130.

The upper portion of the receiver tank 130 is supported by one of the headers 101 via a bracket (not shown) or the like, while the receiver tank inlet and outlet 131 and 132 are communicated with the end of the inlet flow passage 141 and that of the outlet flow passage 142 of the block flange 140, respectively, via joint pipes 145 and 145. In this state the lower end closing member 136 of the receiver tank 130 is secured to the upper surface of the block flange 140 by tightening screws (not shown) inserted in the block flange 140 to the lower end closing member 136.

In a refrigeration system for car air-conditioners in which such a heat exchanger with a receiver tank is applied, in order to effectively utilize a restricted space in a car body as much as possible, it is desired to further reduce the size of the entire system. In addition, in a refrigeration cycle for car air-conditioners, it is desired to enhance the performance to load fluctuations (overcharge toughness) and suppress the performance deterioration with time due to continuous running (deterioration of leakage toughness). In order to achieve the desires, it is desired to widely secure a steady range of refrigerant, i.e., a stability range in a subcooling state of refrigerant relative to an amount of sealed refrigerant.

In the aforementioned conventional heat exchanger with a receiver tank, however, since the lower end closing member 136 of the receiver tank 130 is fixed to the block flange 140 by using screws, it is required for the lower end closing member 136 to have a thickness such that the lower end closing member 136 can be secured to the block flange 140 by using screws. Accordingly, the volume of the receiver tank decreases, which in turn causes a narrow stability range of the subcooling state of refrigerant, an excessive amount of refrigerant, or an insufficient amount of refrigerant. Thus, it was difficult to obtain stable refrigeration performance.

Furthermore, since the receiver tank 130 is secured to the block flange 140 by using screws, it is required to perform troublesome thread-fastening operation, resulting in troublesome/difficult assembling operation.

It is an object of the present invention to provide a heat exchanger with a receiver tank and a refrigeration system capable of solving the problem of the aforementioned conventional technique, obtaining stable refrigeration performance and performing easy assembling operation.

Other objects and advantages of the present invention will be apparent from the following preferred embodiments.

DISCLOSURE OF INVENTION

According to the 1st (first) aspect of the present invention, a heat exchanger with a receiver tank, comprises:

a heat exchanger body including a pair of headers, a plurality of heat exchanging tubes disposed in parallel with each other between the pair of headers with opposite ends of the heat exchanging tube communicated with the headers and a condensing portion constituted by the heat exchanging tubes, wherein a refrigerant condensed by the condensing portion is made to flow out of a condensing portion outlet of one of the headers;

a slender receiver tank disposed along the one of headers, the receiver tank having a tank main body, a receiver tank inlet and a receiver tank outlet each communicated with an inside of the tank main body;

a joint member joined to the condensing portion outlet of the one of headers and therearound, the joint member having an upper surface on which a lower end of the receiver tank is assembled; and a bracket for supporting the receiver tank to the one of the headers, wherein the joint member is provided with an inlet flow passage having one end communicated with the condensing portion outlet and the other end communicated with the receiver tank inlet and an outlet flow passage having one end communicated with the receiver tank outlet, wherein the receiver tank has a pressing stepped portion formed on a periphery of the tank main body, and wherein the bracket is provided with a joint portion joined to a periphery of the one of headers and an embracing portion which surrounds the periphery of the tank main body and engages with the pressing stepped portion to downwardly press the receiver tank.

In this heat exchanger with a receiver tank, since the receiver tank is secured to the joint member by downwardly pressing the receiver tank with the bracket, the lower portion of the receiver tank can be assuredly connected to the joint member without using screws. Furthermore, it is not required to increase the thickness of the lower wall of the receiver tank bottom wall so that the lower wall can be secured to the joint member by screws. In addition to the above, it becomes possible to decrease the size and the weight and increase the tank volume. Furthermore, since the screw tightening operation for securing the receiver tank to the joint member can be is omitted, the assembly operation of the receiver tank can be performed easily.

In the 1st (first) aspect of the present invention, it is preferable that the pressing stepped portion is constituted by a ridge portion formed on a periphery of the tank main body, wherein the ridge portion continuously extends in a circumferential direction of the tank main body. In cases where this structure is adopted, the receiver tank can be downwardly pressed uniformly along the entire circumference thereof, which enables to stably attach the receiver tank to the joint member.

In the 1st (first) aspect of the present invention, the present invention can be preferably adapted to the so-called subcool system condenser having a subcooling portion.

That is, in the 1st (first) aspect of the present invention, it is preferable that an inside of the pair of headers is divided, so that the plurality of the heat exchanging tubes are grouped into the condensing portion and a subcooling portion for subcooling a liquefied refrigerant, wherein the one of headers is provided with a subcooling portion inlet communicated with the subcooling portion, and wherein the other end of the outlet flow passage in the joint member is communicated with the subcooling portion inlet.

In the 1st (first) aspect of the present invention, it is preferable that desiccating agents are disposed at a lower portion in the tank main body, wherein the receiver tank inlet is formed at a bottom surface of the tank main body, and wherein a lower end of a refrigerant inflow pipe disposed in the tank main body is communicated with the receiver tank outlet, while an upper end thereof is opened above the desiccating agents. In cases where this structure is adopted, the refrigerant can be smoothly separated into a gaseous refrigerant and a liquefied refrigerant, enabling a stable supply of refrigerant.

In the 1st (first) aspect of the present invention, it is preferable that the bracket includes a bracket main body and a one side embracing member which is a member separated from the bracket main body, wherein the embracing portion is constituted by one side embracing portion provided at the bracket main body and disposed along one side half periphery of the tank main body and the other side embracing portion provided at the one side embracing member and disposed along the other side half periphery of the tank main body, wherein the joint portion is constituted by an end portion of the bracket main body.

In cases where this structure is adopted, the receiver tank can be attached more assuredly.

In the 1st (first) aspect of the present invention, it is preferable that the one side embracing member is provided with a vertically extended screw insertion slot at one end thereof, wherein a screw inserted in the screw insertion slot is screwed into the bracket main body in a state that an entire periphery of the tank main body is surrounded by the one side embracing portion and the other side embracing portion, whereby the one side embracing member is fixed to the bracket main body. In cases where this structure is adopted, the so-called rocket phenomenon that the receiver tank jumps out unpredictably during the maintenance of the receiver tank can be prevented.

In the 1st (first) aspect of the present invention, it is preferable that the one side embracing member is attached to the bracket main body in a vertically slidable manner at the other end thereof. In cases where this structure is adopted, since the receiver tank slides upward a little at the time of the aforementioned rocket phenomenon, deflation can be performed automatically.

In the 1st (first) aspect of the present invention, it is preferable that the one side embracing member is provided with a vertically extended axial portion at the other end thereof, and wherein the bracket main body is provided with an axial portion holding groove accommodating the axial portion in such a manner that the axial portion is slidable vertically and rotatable around the axial portion. In cases where this structure is adopted, the attachment of the receiver tank using the bracket can be performed easily.

In the 1st (first) aspect of the present invention, it is preferable that the bracket main body is provided with a screw hole for securing the screw therein, and wherein the screw is secured in the screw hole. In cases where this structure is adopted, the attachment of the receiver tank can be performed more assuredly.

In the 1st (first) aspect of the present invention, it is preferable that the one side embracing member is provided with a first screw insertion hole and a second screw insertion hole at one end thereof, wherein a first screw and a second screw inserted in the first screw insertion hole and the second screw insertion hole respectively are screwed into the bracket main body in a state that an entire periphery of the tank main body is surrounded by the one side embracing portion and the other side embracing portion, whereby the one side embracing member is fixed to the bracket main body. In cases where this structure is adopted, the receiver tank can be attached to the heat exchanger body assuredly.

In the $1^{st}$ (first) aspect of the present invention, it is preferable that the second screw insertion hole is a vertically extended slot. In cases where this structure is adopted, the aforementioned rocket phenomenon can be prevented more assuredly.

In the $1^{st}$ (first) aspect of the present invention, it is preferable that the one side embracing member is attached to the bracket main body in a vertically slidable manner at the other end thereof. In cases where this structure is adopted, deflation can be performed automatically when the aforementioned rocket phenomenon arises.

In the $1^{st}$ (first) aspect of the present invention, it is preferable that the bracket main body is provided with a first screw hole and a second screw hole for securing the first screw and the second screw therein, and wherein the second screw is secured in the second screw hole. In cases where this structure is adopted, the aforementioned rocket phenomenon can be prevented more assuredly.

In the $1^{st}$ (first) aspect of the present invention, it is preferable that the second screw is a synthetic resin molded article having an axial portion to be inserted in the second screw hole and a pull-out-preventing portion provided at a periphery of a tip portion of the axial portion, the pull-out-preventing portion being capable of elastically shrinking. In cases where this structure is adopted, the second screw can be secured more assuredly.

In the $2^{nd}$ (second) aspect of the present invention, a heat exchanger with a receiver tank, comprises:

a heat exchanger body including a pair of headers, a plurality of heat exchanging tubes disposed in parallel with each other between the pair of headers with opposite ends of the heat exchanging tube communicated with the headers and a condensing portion constituted by the heat exchanging tubes, wherein the heat exchanger body flows out condensed refrigerant condensed by the condensing portion of a condensing portion outlet of one of the headers;

a slender receiver tank disposed along the one of headers, the receiver tank having a tank main body, a receiver tank inlet and a receiver tank outlet each communicated with an inside of the tank main body;

a joint member joined to the condensing portion outlet of the one of headers and therearound, the joint member having an upper surface on which a lower end of the receiver tank is assembled; and a bracket for supporting the receiver tank to the one of the headers, wherein the joint member is provided with an inlet flow passage having one end communicated with the condensing portion outlet and the other end communicated with the receiver tank inlet and an outlet flow passage having one end communicated with the receiver tank outlet, wherein the receiver tank has a pressing stepped portion formed on a periphery of the tank main body, wherein the bracket is provided with a joint portion joined to the periphery of the one of headers and an embracing portion which surrounds the periphery of the tank main body and engages with the pressing stepped portion to downwardly press the receiver tank, wherein the receiver tank is provided with a downwardly protruded convex stepped portion at a lower surface of the receiver tank, while the joint member is provided with a concave stepped portion at an upper surface of the joint member, and wherein the receiver tank is assembled to the joint member in a state that the convex stepped portion is fitted in the concave stepped portion.

In this $2^{nd}$ (second) aspect of the present invention, the positioning of the inlet-and-outlet of the receiver tank and the inlet-and-outlet of the inlet and outlet flow passages of the joint member can be performed by simply fitting the convex stepped portion for inlet-and-outlet formed at the receiver-tank lower end into the concave stepped portion for inlet-and-outlet formed on the upper surface of the joint member. Accordingly, the receiver tank can be attached to the joint member simply and correctly.

In the $2^{nd}$ (second) aspect of the present invention, it is preferable that the pressing stepped portion is constituted by a ridge portion formed on a periphery of the tank main body, the ridge portion continuously extending in a circumferential direction of the tank main body. In cases where this structure is adopted, the receiver tank can be downwardly pressed uniformly along the entire circumference thereof, which enables the receiver tank to be stably attached to the joint member.

In the $2^{nd}$ (second) aspect of the present invention, the present invention can be preferably adapted to the so-called subcool system condenser having a subcooling portion.

That is, in the $2^{nd}$ (second) aspect of the present invention, it is preferable that an inside of the pair of headers is divided, so that the plurality of the heat exchanging tubes are grouped into the condensing portion and a subcooling portion for subcooling a liquefied refrigerant, wherein the one of headers is provided with a subcooling portion inlet communicated with the subcooling portion, and wherein the other end of the outlet flow passage in the joint member is communicated with the subcooling portion inlet.

In the $2^{nd}$ (second) aspect of the present invention, it is preferable that desiccating agents are disposed at a lower portion in the tank main body, wherein the receiver tank inlet is formed at a bottom surface of the tank main body, and wherein a lower end of a refrigerant inflow pipe disposed in the tank main body is communicated with the receiver tank outlet, while an upper end thereof is opened above the desiccating agents. In cases where this structure is adopted, the refrigerant can be smoothly separated into a gaseous refrigerant and a liquefied refrigerant, enabling a stable supply of refrigerant.

In the $3^{rd}$ (third) aspect of the present invention, a heat exchanger with a receiver tank, comprises:

a heat exchanger body including a pair of headers, a plurality of heat exchanging tubes disposed in parallel with each other between the pair of headers with opposite ends of the heat exchanging tube communicated with the headers and a condensing portion constituted by the heat exchanging tubes, wherein a refrigerant condensed by the condensing portion is made to flow out of a condensing portion outlet of one of the headers;

a slender receiver tank disposed along the one of headers, the receiver tank having a tank main body with a pressing stepped portion on a peripheral surface of the tank main body, and an inlet-and-outlet portion formed on a lower end of the tank main body;

a joint member joined to the condensing portion outlet of the one of headers and therearound, the joint member having an upper surface on which the inlet-and-outlet portion of the receiver tank is assembled; and a bracket for supporting the receiver tank to the one of the headers, wherein the joint member is provided with an inlet concave stepped portion formed on an upper surface thereof, an outlet concave stepped portion formed in a bottom surface of the inlet concave stepped portion, an inlet flow passage having one end opened to a joining surface of the one of headers and communicated with the condensing portion outlet and the other end opened to the inlet concave stepped portion, and an outlet flow passage having one end opened to the outlet concave stepped portion, wherein the inlet-and-outlet portion is provided with a downwardly protruded inlet convex stepped portion formed on a lower surface thereof, a downwardly protruded outlet convex stepped portion formed on a lower end surface of the inlet convex stepped portion, a receiver tank inlet formed in the inlet convex stepped portion and communicated with an inside of the tank main body, and a receiver tank outlet formed in the outlet convex stepped portion and communicated with an inside of the tank main body, wherein the bracket is provided with a joint portion joined to the periphery of the one of headers and an embracing portion which surrounds the periphery of the tank main body and engages with the pressing stepped portion to downwardly press the receiver tank, and wherein the receiver tank is assembled to the joint member in a state that the inlet convex stepped portion and the outlet convex stepped portion are fitted in the inlet concave stepped portion and the outlet concave stepped portion, respectively, and that the receiver tank is downwardly pressed by the bracket.

In this third aspect of the present invention, the positioning of the inlet-and-outlet of the receiver tank and the inlet-and-outlet of the inlet and outlet flow passages of the joint member can be performed by simply fitting the convex stepped portion for inlet-and-outlet formed at the receiver-tank lower end into the concave stepped portion for inlet-and-outlet formed on the upper surface of the joint member. Accordingly, the receiver tank can be attached to the joint member simply and correctly.

In the $3^{rd}$ (third) aspect of the present invention, it is preferable that the pressing stepped portion is constituted by a ridge portion formed on a periphery of the tank main body, the ridge portion continuously extending in a circumferential direction of the tank main body. In cases where this structure is adopted, the receiver tank can be downwardly pressed uniformly along the entire circumference thereof, which enables to stably attach the receiver tank to the joint member.

In the $3^{rd}$ (third) aspect of the present invention, the present invention can be preferably adapted to the so-called subcool system condenser having a subcooling portion.

That is, in the $3^{rd}$ (third) aspect of the present invention, it is preferable that an inside of the pair of headers is divided, so that the plurality of the heat exchanging tubes are grouped into the condensing portion and a subcooling portion for subcooling a liquefied refrigerant, wherein the one of headers is provided with a subcooling portion inlet communicated with the subcooling portion, and wherein the other end of the outlet flow passage in the joint member is communicated with the subcooling portion inlet.

In the $3^{rd}$ (third) aspect of the present invention, it is preferable that desiccating agents are disposed at a lower portion in the tank main body, wherein the receiver tank inlet is formed at a bottom surface of the tank main body, and wherein a lower end of a refrigerant inflow pipe disposed in the tank main body is communicated with the receiver tank outlet, while an upper end thereof is opened above the desiccating agents. In cases where this structure is adopted, the refrigerant can be smoothly separated into a gaseous refrigerant and a liquefied refrigerant, enabling a stable supply of refrigerant.

In the $3^{rd}$ (third) aspect of the present invention, it is preferable that the inlet convex stepped portion and the outlet convex stepped portion are circular in cross-section, respectively, and wherein the inlet convex stepped portion and the outlet convex stepped portion are formed such that an axial center thereof coincides with an axial center of the receiver tank. In cases where this structure is adopted, even if the receiver is rotated in either rotational direction relative to the joint member, the receiver tank can be secured to the joint member smoothly. Thus, the positioning operation in the circumferential direction about the axis thereof becomes unnecessary, resulting in reduced burden of the assembling operator.

In the $3^{rd}$ (third) aspect of the present invention, it is preferable that the outlet convex stepped portion is provided with a pull-out-preventing projection protruded sideways on a periphery of the outlet convex stepped portion, wherein the outlet concave stepped portion is provided with a projection introducing notch and a projection engaging slot at an inner periphery thereof, the projection introducing notch having an upper end opened to a periphery of the outlet concave stepped portion in the inlet concave stepped portion and extending downwardly along an axis thereof, and the projection engaging slot having one end communicated with a lower end of the projection introducing notch and extending in a circumferential direction along an inner periphery of the outlet concave stepped portion, wherein the receiver tank is rotated about an axial center thereof in a state that the outlet convex stepped portion is fitted in the outlet concave stepped portion with the pull-out-preventing projection inserted in the projection introducing notch, whereby the receiver tank is secured to the joint member with the pull-out-preventing projection engaged with the projection engaging slot.

In cases where this structure is adopted, the receiver tank can be secured to the joint member more assuredly.

In the $4^{th}$ (fourth) aspect of the present invention, a heat exchanger with a receiver tank, comprises:

a heat exchanger body including a pair of vertical headers, a plurality of heat exchanging tubes disposed in parallel with each other between the pair of headers with opposite ends of the heat exchanging tube communicated with the headers and a partition provided in the header to group the plurality of heat exchanging tubes into an upper condensing portion and a lower subcooling portion, wherein a condensing portion outlet is provided at a position corresponding to a lower end of the condensing portion of the one of headers for flowing out a refrigerant from the condensing portion, and a subcooling portion inlet is provided at a position corresponding to the subcooling portion of the one of headers for introducing the refrigerant into the subcooling portion;

a slender receiver tank disposed along the one of headers, the receiver tank having a tank main body, a receiver tank inlet and a receiver tank outlet formed at a lower end of the tank main body and communicated with an inside of the tank main body;

a joint member joined to a region including the condensing portion outlet and the subcooling inlet of the one of headers, the joint member having an upper surface on which a lower end of the receiver tank is assembled; and a bracket for supporting the receiver tank to the one of the headers, wherein the joint member is provided with an inlet flow passage having an inlet side end portion communicated with the condensing portion outlet and an outlet side end portion communicated with the receiver tank inlet and an outlet flow passage having an inlet side end portion communicated with the receiver tank outlet and an outlet side end portion communicated with the subcooling portion inlet, wherein the receiver tank has a pressing stepped portion formed on a periphery of the tank main body, wherein the bracket is provided with a joint portion joined to the periphery of the one of headers and an embracing portion which surrounds the periphery of the tank main body and engages with the pressing stepped portion to downwardly press the receiver tank, and wherein a part of the inlet flow passage extends downward so that an outlet side end portion of the inlet flow passage is arranged at a position lower than a position of the condensing portion outlet.

In this $4^{th}$ (fourth) aspect, since a part of the inlet flow passage extends downward so that an outlet side end portion of the inlet flow passage is arranged at a position lower than a position of the condensing portion outlet, the receiver tank can be mounted at a lower position, which in turn enables an employment of a longer receiver tank. Accordingly, enough tank volume can be secured.

Furthermore, since a longer receiver tank can be used, it is possible to secure enough tank volume while reducing the diameter thereof, which further enhances the performance of the receiver tank.

In the $4^{th}$ (fourth) aspect of the present invention, it is preferable that the pressing stepped portion is constituted by a ridge portion formed on a periphery of the tank main body, the ridge portion continuously extending in a circumferential direction of the tank main body. In cases where this structure is adopted, the receiver tank can be downwardly pressed uniformly along the entire circumference thereof, which enables to stably attach the receiver tank to the joint member.

In the $4^{th}$ (fourth) aspect of the present invention, it is preferable that desiccating agents are disposed at a lower portion in the tank main body, wherein the receiver tank inlet is formed at a bottom surface of the tank main body, and wherein a lower end of a refrigerant inflow pipe disposed in the tank main body is communicated with the receiver tank outlet, while an upper end thereof is opened above the desiccating agents.

In cases where this structure is adopted, the refrigerant can be smoothly separated into a gaseous refrigerant and a liquefied refrigerant, enabling a stable supply of refrigerant.

In the $4^{th}$ (fourth) aspect of the present invention, it is preferable that an outlet side end portion of the inlet flow passage in the joint member is arranged at a position corresponding to the subcooling portion. In cases where this structure is adopted, the receiver tank can be arranged at a lower position assuredly.

In the $4^{th}$ (fourth) aspect of the present invention, it is preferable that the partition provided between the condensing portion and the subcooling portion in the one of headers is provided with an opening constituting the condensing portion outlet, wherein one side portion of the joint member is arranged in the one of headers so as to be located under a lower surface of the partition, wherein an inlet side end portion of the inlet flow passage is opened to an upper surface of the one side portion of the joint member and communicated with the condensing portion outlet, and wherein an outlet side end portion of the outlet flow passage is opened to an inside of the one of headers at a position lower than the partition.

In cases where this structure is adopted, the occupancy space of the joint member can be further decreased, resulting in a compact heat exchanger.

In the $5^{th}$ (fifth) aspect of the present invention, a heat exchanger with a receiver tank, comprises:

a heat exchanger body including a pair of vertical headers, a plurality of heat exchanging tubes disposed in parallel with each other between the pair of headers with opposite ends of the heat exchanging tube communicated with the headers and a partition provided in the header to group the plurality of heat exchanging tubes into an upper condensing portion and a lower subcooling portion, wherein a condensing portion outlet for flowing out a refrigerant from the condensing portion is provided at a position corresponding to a lower end of the condensing portion of the one of headers, and a subcooling portion inlet for introducing the refrigerant into the subcooling portion is provided at a position corresponding to the subcooling portion of the one of headers;

a slender receiver tank disposed along the one of headers, the receiver tank having a tank main body, a receiver tank inlet and a receiver tank outlet each formed at a lower end of the tank main body and each communicated with an inside of the tank main body;

a joint member joined to the one of headers, the joint member having an upper surface on which a lower end of the receiver tank is assembled;

an inlet flow passage pipe having an inlet side end portion communicated with the condensing portion outlet and an outlet side end portion communicated with the receiver tank inlet; and a bracket for supporting the receiver tank to the one of the headers, wherein the joint member is provided with an outlet flow passage having an inlet side end portion communicated with the receiver tank outlet and an outlet side end portion communicated with the subcooling portion inlet, wherein the receiver tank has a pressing stepped portion formed on a periphery of the tank main body, wherein the bracket is provided with a joint portion joined to the periphery of the one of headers and an embracing portion which surrounds the periphery of the tank main body and engages with the pressing stepped portion to downwardly press the receiver tank, and wherein a part of the inlet flow passage pipe extends downward so that an outlet side end portion of the inlet flow passage pipe is arranged at a position lower than a position of the condensing portion outlet.

In the $5^{th}$ (fifth) aspect of the present invention, a part of the inlet flow passage pipe for introducing the refrigerant into the receiver tank extends downward, and the outlet side end portion of the inlet flow passage pipe is arranged at a lower position. Accordingly, the mounting position of the receiver tank can be arranged at a lower position as a whole. Thus, a longer receiver tank can be employed, which in turn secures enough tank volume.

Furthermore, since a longer receiver tank can be used, it is possible to secure enough tank volume while reducing the diameter thereof, which further enhances the performance of the receiver tank.

In the $5^{th}$ (fifth) aspect of the present invention, it is preferable that the outlet side end portion of the inlet flow passage pipe is arranged at a height position corresponding to the subcooling portion. In cases where this structure is adopted, the receiver tank can be mounted at a lower position assuredly.

In the $6^{th}$ (sixth) aspect of the present invention, a heat exchanger with a receiver tank, comprises:

a heat exchanger body including a pair of headers, a plurality of heat exchanging tubes disposed in parallel with each other between the pair of headers with opposite ends of the heat exchanging tube communicated with the headers and a condensing portion constituted by the heat exchanging tubes, wherein a refrigerant condensed by the condensing portion is made to flow out of a condensing portion outlet of one of the headers;

a slender receiver tank disposed along the one of headers, the receiver tank having a tank main body, a receiver tank inlet and a receiver tank outlet formed at a lower end of the tank main body and communicated with an inside of the tank main body;

a joint member joined to the condensing portion outlet of the one of headers, the joint member having an upper surface on which a lower end of the receiver tank is assembled; and a bracket for supporting the receiver tank to the one of the headers, wherein the joint member is provided with an inlet flow passage having an inlet side end portion communicated with the condensing portion outlet and an outlet side end portion communicated with an receiver tank inlet and an outlet flow passage having an outlet side end portion communicated with the receiver tank outlet, wherein the receiver tank has a pressing stepped portion formed on a periphery of the tank main body, wherein the bracket is provided with a joint portion joined to the periphery of the one of headers and an embracing portion which surrounds the periphery of the tank main body and engages with the pressing stepped portion to downwardly press the receiver tank, and wherein a liquid-stagnating portion for storing a refrigerant is formed between the outlet side end portion of the inlet flow passage in the joint member and the receiver tank inlet.

In this $6^{th}$ (sixth) aspect, the refrigerant flowed out through the inlet flow passage in the joint member is stored in the liquid-stagnating portion to be decreased in the refrigerant flow velocity, bubbles can be smoothly extinguished with efficient. Accordingly, it becomes possible to effectively prevent the gaseous refrigerant from being introduced into the receiver tank, which enables an assured extraction of only the stable liquefied refrigerant.

Furthermore, since the stable supply of the liquefied refrigerant can be performed due to the improved bubble extinguishing, the receiver tank can be reduced in size and weight.

In the $6^{th}$ (sixth) aspect of the present invention, it is preferable that the pressing stepped portion is constituted by a ridge portion formed on a periphery of the tank main body, the ridge portion continuously extending in a circumferential direction of the tank main body.

In cases where this structure is adopted, the receiver tank can be downwardly pressed uniformly along the entire circumference thereof, which enables to stably attach the receiver tank to the joint member.

In the $6^{th}$ (sixth) aspect of the present invention, the present invention can be preferably adapted to the so-called subcool system condenser having a subcooling portion.

In the $6^{th}$ (sixth) aspect of the present invention, it is preferable that an inside of the pair of headers is divided, so that the plurality of the heat exchanging tubes are grouped into the condensing portion and a subcooling portion for subcooling a liquefied refrigerant, wherein the one of headers is provided with a subcooling portion inlet communicated with the subcooling portion, and wherein an outlet side end portion of the outlet flow passage in the joint member is communicated with the subcooling portion inlet.

In the $6^{th}$ (sixth) aspect of the present invention, it is preferable that desiccating agents are disposed at a lower portion in the tank main body, wherein the receiver tank inlet is formed at a bottom surface of the tank main body, and wherein a lower end of a refrigerant inflow pipe disposed in the tank main body is communicated with the receiver tank outlet, while an upper end thereof is opened above the desiccating agents.

In cases where this structure is adopted, the refrigerant can be smoothly separated into a gaseous refrigerant and a liquefied refrigerant, enabling a stable supply of refrigerant.

In the $6^{th}$ (sixth) aspect of the present invention, it is preferable that the joint member is provided with an inlet concave stepped portion formed on an upper surface thereof and an outlet concave stepped portion formed in a bottom surface of the inlet concave stepped portion, an outlet side end portion of the inlet flow passage being opened to the inlet concave stepped portion, while an inlet side end portion of the outlet flow passage being opened to the outlet concave stepped portion, wherein the receiver tank has a downwardly protruded inlet convex stepped portion formed on a lower end thereof and a downwardly protruded outlet convex stepped portion formed on a lower end of the inlet convex stepped portion, the inlet convex stepped portion having the receiver tank inlet, the outlet convex stepped portion having the receiver tank outlet, wherein the inlet convex stepped portion and the outlet convex stepped portion are fitted in the inlet concave stepped portion and the outlet concave stepped portion, respectively, to thereby attach the receiver tank to the joint member, and wherein the liquid stagnating portion is constituted by a gap formed between a lower end surface of the inlet convex stepped portion and a bottom surface of the inlet concave stepped portion in a state that the receiver tank is attached to the joint member.

In cases where this structure is adopted, the positioning of the inlet-and-outlet of the receiver tank and the inlet-and-outlet of the inlet and outlet flow passages of the joint member can be performed by simply fitting the convex stepped portion for inlet-and-outlet formed at the receiver-tank lower end into the concave stepped portion for inlet-and-outlet formed on the upper surface of the joint member. Accordingly, the receiver tank can be attached to the joint member simply and correctly.

In the $6^{th}$ (sixth) aspect of the present invention, it is preferable that a plurality of the receiver tank inlets are formed in a periphery of the outlet convex stepped portion at regular intervals along a circumferential direction thereof. In cases where this structure is adopted, it becomes possible to evenly introduce the refrigerant into the tank from the periphery of the lower end of the receiver tank in a dispersed manner. Therefore, a biased refrigerant flow or generation of bubbles or gas due to turbulence can be prevented, resulting in an enhanced bubble prevention effect.

In the $7^{th}$ (seventh) aspect of the present invention, a heat exchanger with a receiver tank, comprises:

a heat exchanger body including a pair of headers, a plurality of heat exchanging tubes disposed in parallel with each other between the pair of headers with opposite ends of the heat exchanging tube communicated with the headers and a condensing portion constituted by the heat exchanging tubes, wherein a refrigerant condensed by the condensing portion is made to flow out of a condensing portion outlet of one of the headers;

a slender receiver tank disposed along the one of headers, the receiver tank having a tank main body, a receiver tank inlet and a receiver tank outlet each formed at a lower end of the tank main body and each communicated with an inside of the tank main body;

a joint member joined to a condensing portion outlet of the one of headers and therearound, the joint member having an upper surface on which a lower end of the receiver tank is assembled; and a bracket for supporting the receiver tank to the one of the headers, wherein the joint member is provided with an inlet flow passage having an inlet side end communicated with the condensing portion outlet and an outlet side end communicated with the receiver tank inlet and an outlet flow passage having an inlet side end portion communicated with the receiver tank outlet, wherein the receiver tank has a pressing stepped portion formed on a periphery of the tank main body, wherein the bracket is provided with a joint portion joined to the periphery of the one of headers and an embracing portion which surrounds the periphery of the tank main body and engages with the pressing stepped portion to downwardly press the receiver tank, and wherein an opening area of the receiver tank inlet is formed to be larger than an opening area of the receiver tank outlet.

In this $7^{th}$ (seventh) aspect of the present invention, the inflow rate of the refrigerant in the receiver tank inlet can be decreased. Accordingly, the generation of bubbles or gas in the refrigerant can be prevented, resulting in an improved bubble extinguishing effect, which in turn enables a stable supplying of the refrigerant.

In the $7^{th}$ (seventh) aspect of the present invention, it is preferable that the pressing stepped portion is constituted by a ridge portion formed on a periphery of the tank main body, the ridge portion continuously extending in a circumferential direction of the tank main body. In cases where this structure is adopted, the receiver tank can be downwardly pressed uniformly along the entire circumference thereof, which enables to stably attach the receiver tank to the joint member.

In the $7^{th}$ (seventh) aspect of the present invention, the present invention can be preferably adapted to the so-called subcool system condenser having a subcooling portion.

In the $7^{th}$ (seventh) aspect of the present invention, it is preferable that an inside of the pair of headers is divided, so that the plurality of the heat exchanging tubes are grouped into the condensing portion and a subcooling portion for subcooling a liquefied refrigerant, wherein the one of headers is provided with a subcooling portion inlet communicated with the subcooling portion, and wherein an outlet side end portion of the outlet flow passage in the joint member is communicated with the subcooling portion inlet.

In the $7^{th}$ (seventh) aspect of the present invention, it is preferable that desiccating agents are disposed at a lower portion in the tank main body, wherein the receiver tank inlet is formed at a bottom surface of the tank main body, and wherein a lower end of a refrigerant inflow pipe disposed in the tank main body is communicated with the receiver tank outlet, while an upper end thereof is opened above the desiccating agents.

In cases where this structure is adopted, the refrigerant can be smoothly separated into a gaseous refrigerant and a liquefied refrigerant, enabling a stable supply of refrigerant.

In the $7^{th}$ (seventh) aspect of the present invention, it is preferable that the joint member is provided with an inlet concave stepped portion formed on an upper surface thereof and an outlet concave stepped portion formed on a bottom surface of the inlet concave stepped portion an outlet side end portion of the inlet flow passage being opened to the inlet concave stepped portion, while an inlet side end portion of the outlet flow passage being opened to the outlet concave stepped portion, wherein the receiver tank has a downwardly protruded inlet convex stepped portion formed on a lower end thereof and a downwardly protruded outlet convex stepped portion formed on a lower end of the inlet convex stepped portion, the inlet convex stepped portion having the receiver tank inlets on a periphery of the outlet convex stepped portion at certain intervals in a circumferential direction thereof, the outlet convex stepped portion having the receiver tank outlet, wherein the inlet convex stepped portion and the outlet convex stepped portion are fitted in the inlet concave stepped portion and the outlet concave stepped portion, respectively, to thereby attach the receiver-tank to the joint member.

In cases where this structure is adopted, it becomes possible to evenly introduce the refrigerant into the tank from the periphery of the lower end of the receiver tank in a dispersed manner. Therefore, a biased refrigerant flow or generation of bubbles or gas due to turbulence can be prevented, resulting in an enhanced bubble prevention effect.

Furthermore, the positioning of the inlet-and-outlet of the receiver tank and the inlet-and-outlet of the inlet and outlet flow passages of the joint member can be performed by simply fitting the convex stepped portion for inlet-and-outlet formed at the receiver-tank lower end into the concave stepped portion for inlet-and-outlet formed on the upper surface of the joint member. Accordingly, the receiver tank can be attached to the joint member simply and correctly.

The $8^{th}$ (eighth) aspect of the present invention is directed to a refrigeration system utilizing the heat exchanger with a receiver tank according to the first aspect of the present invention.

In the $8^{th}$ (eighth) aspect of the present invention, a refrigeration system in which a refrigerant compressed by a compressor is condensed by a heat exchanger with a receiver tank, the condensed refrigerant is decompressed by passing through a decompressing device, and the decompressed refrigerant is evaporated by an evaporator and then returned to the compressor, the heat exchanger with a receiver tank, comprises:

a heat exchanger body including a pair of headers, a plurality of heat exchanging tubes disposed in parallel with each other between the pair of headers with opposite ends of the heat exchanging tube communicated with the headers and a condensing portion constituted by the heat exchanging tubes, wherein a refrigerant condensed by the condensing portion is made to flow out of a condensing portion outlet of one of the headers;

a slender receiver tank disposed along the one of headers, the receiver tank having a tank main body, a receiver tank inlet and a receiver tank outlet each communicated with an inside of the tank main body;

a joint member joined to the condensing portion outlet of the one of headers and therearound, the joint member having an upper surface on which a lower end of the receiver tank is assembled; and a bracket for supporting the receiver tank to the one of the headers, wherein the joint member is provided with an inlet flow passage having one end communicated with the condensing portion outlet and the other end communicated with the receiver tank inlet and an outlet flow passage having one end communicated with the receiver tank outlet, wherein the receiver tank has a pressing stepped portion formed on a periphery of the tank main body, and wherein the bracket is provided with a joint portion joined to the periphery of the one of headers and an embracing portion which surrounds the periphery of the tank main body and engages with the pressing stepped portion to downwardly press the receiver tank.

Since this $8^{th}$ (eighth) aspect is directed to the refrigeration system utilizing the heat exchanger with a receiver tank according to the first aspect of the present invention, the same functions and effects as mentioned above can be obtained.

In the $8^{th}$ (eighth) aspect of the present invention, the present invention can be preferably adapted to the so-called subcool system condenser having a subcooling portion.

In the $8^{th}$ (eighth) aspect of the present invention, it is preferable that an inside of the pair of headers is divided, so that the plurality of the heat exchanging tubes are grouped into the condensing portion and a subcooling portion for subcooling a liquefied refrigerant, wherein the one of headers is provided with a subcooling portion inlet communicated with the subcooling portion, and wherein the other end of the outlet flow passage in the joint member is communicated with the subcooling portion inlet.

This $9^{th}$ (ninth) aspect of the present invention is directed to the refrigeration system utilizing the heat exchanger with a receiver tank according to the $2^{nd}$ (second) aspect of the present invention, In the $9^{th}$ (ninth) aspect of the present invention, a refrigeration system in which a refrigerant compressed by a compressor is condensed by a heat exchanger with a receiver tank, the condensed refrigerant is decompressed by passing through a decompressing device, and the decompressed refrigerant is evaporated by an evaporator and then returned to the compressor, the heat exchanger with a receiver tank, comprising:

a heat exchanger body including a pair of headers, a plurality of heat exchanging tubes disposed in parallel with each other between the pair of headers with opposite ends of the heat exchanging tube communicated with the headers and a condensing portion constituted by the heat exchanging tubes, wherein a refrigerant condensed by the condensing portion is made to flow out of a condensing portion outlet of one of the headers;

a slender receiver tank disposed along the one of headers, the receiver tank having a tank main body, a receiver tank inlet and a receiver tank outlet each communicated with an inside of the tank main body;

a joint member joined to the condensing portion outlet of the one of headers and therearound, the joint member having an upper surface on which a lower end of the receiver tank is assembled; and a bracket for supporting the receiver tank to the one of the headers, wherein the joint member is provided with an inlet flow passage having one end communicated with the condensing portion outlet and the other end communicated with the receiver tank inlet and an outlet flow passage having one end communicated with the receiver tank outlet, wherein the receiver tank has a pressing stepped portion formed on a periphery of the tank main body, wherein the bracket is provided with a joint portion joined to the periphery of the one of headers and an embracing portion which surrounds the periphery of the tank main body and engages with the pressing stepped portion to downwardly press the receiver tank, wherein the receiver tank is provided with a downwardly protruded convex stepped portion at a lower surface of the receiver tank, while the joint member is provided with a concave stepped portion at an upper surface of the joint member, and wherein the receiver tank is assembled to the joint member in a state that the convex stepped portion is fitted in the concave stepped portion.

Since this $9^{th}$ (ninth) aspect is directed to the refrigeration system utilizing the heat exchanger with a receiver tank according to the $2^{nd}$ (second) aspect of the present invention, the same functions and effects as mentioned above can be obtained.

In the $9^{th}$ (ninth) aspect of the present invention, the present invention can be preferably adapted to the so-called subcool system condenser having a subcooling portion.

In the $9^{th}$ (ninth) aspect of the present invention, it is preferable that an inside of the pair of headers is divided, so that the plurality of the heat exchanging tubes are grouped into the condensing portion and a subcooling portion for subcooling a liquefied refrigerant, wherein the one of headers is provided with a subcooling portion inlet communicated with the subcooling portion, and wherein the other end of the outlet flow passage in the joint member is communicated with the subcooling portion inlet.

The $10^{th}$ (tenth) aspect is directed to the refrigeration system utilizing the heat exchanger with a receiver tank according to the third aspect of the present invention.

In the $10^{th}$ (tenth) aspect of the present invention, it is preferable that a refrigeration system in which a refrigerant compressed by a compressor is condensed by a heat exchanger with a receiver tank, the condensed refrigerant is decompressed by passing through a decompressing device, and the decompressed refrigerant is evaporated by an evaporator and then returned to the compressor, the heat exchanger with a receiver tank, comprises:

a heat exchanger body including a pair of headers, a plurality of heat exchanging tubes disposed in parallel with each other between the pair of headers with opposite ends of the heat exchanging tube communicated with the headers and a condensing portion constituted by the heat exchanging tubes, wherein a refrigerant condensed by the condensing portion is made to flow out of a condensing portion outlet of one of the headers;

a slender receiver tank disposed along the one of headers, the receiver tank having a tank main body with a pressing stepped portion on a peripheral surface of the tank main body, and an inlet-and-outlet portion formed on a lower end of the tank main body;

a joint member joined to the condensing portion outlet of the one of headers and therearound, the joint member having an upper surface on which the inlet-and-outlet portion of the receiver tank is assembled; and a bracket for supporting the receiver tank to the one of the headers, wherein the joint member is provided with an inlet concave stepped portion formed on an upper surface thereof, an outlet concave stepped portion formed in a bottom surface of the inlet concave stepped portion, an inlet flow passage having one end opened to a joining surface of the one of headers and communicated with the condensing portion outlet and the other end opened to the inlet concave stepped portion, and an outlet flow passage having one end opened to the outlet concave stepped portion, wherein the inlet-and-outlet portion is provided with a downwardly protruded inlet convex stepped portion formed on a lower surface thereof, a downwardly protruded outlet convex stepped portion formed on a lower end surface of the inlet convex stepped portion, a receiver tank inlet formed in the inlet convex stepped portion and communicated with an inside of the tank main body, and a receiver tank outlet formed in the outlet convex stepped portion and communicated with an inside of the tank main body, wherein the bracket is provided with a joint portion joined to the periphery of the one of headers and an embracing portion which surrounds the periphery of the tank main body and engages with the pressing stepped portion to downwardly press the receiver tank, and wherein the receiver tank is assembled to the joint member in a state that the inlet convex stepped portion and the outlet convex stepped portion are fitted in the inlet concave stepped portion and the outlet concave stepped portion, respectively, and that the receiver tank is downwardly pressed by the bracket.

Since this $10^{th}$ (tenth) aspect is directed to the refrigeration system utilizing the heat exchanger with a receiver tank according to the $3^{rd}$ (third) aspect of the present invention, the same functions and effects as mentioned above can be obtained.

In the $10^{th}$ (tenth) aspect of the present invention, the present invention can be preferably adapted to the so-called subcool system condenser having a subcooling portion.

In the $10^{th}$ (tenth) aspect of the present invention, it is preferable that an inside of the pair of headers is divided, so that the plurality of the heat exchanging tubes are grouped into the condensing portion and a subcooling portion for subcooling a liquefied refrigerant, wherein the one of headers is provided with a subcooling portion inlet communicated with the subcooling portion, and wherein the other end of the outlet flow passage in the joint member is communicated with the subcooling portion inlet.

The $11^{th}$ (eleventh) aspect is directed to the refrigeration system utilizing the heat exchanger with a receiver tank according to the $4^{th}$ (fourth) aspect of the present invention.

In the $11^{th}$ (eleventh) aspect of the present invention, a refrigeration system in which a refrigerant compressed by a compressor is condensed by a heat exchanger with a receiver tank, the condensed refrigerant is decompressed by passing through a decompressing device, and the decompressed refrigerant is evaporated by an evaporator and then returned to the compressor, the heat exchanger with a receiver tank, comprises:

a heat exchanger body including a pair of vertical headers, a plurality of heat exchanging tubes disposed in parallel with each other between the pair of headers with opposite ends of the heat exchanging tube communicated with the headers and a partition provided in the header to group the plurality of heat exchanging tubes into an upper condensing portion and a lower subcooling portion, wherein a condensing portion outlet is provided at a position corresponding to a lower end of the condensing portion of the one of headers for flowing out a refrigerant from the condensing portion, and a subcooling portion inlet is provided at a position corresponding to the subcooling portion of the one of headers for introducing the refrigerant into the subcooling portion;

a slender receiver tank disposed along the one of headers, the receiver tank having a tank main body, a receiver tank inlet and a receiver tank outlet formed at a lower end of the tank main body and communicated with an inside of the tank main body;

a joint member joined to a region including the condensing portion outlet and the subcooling inlet of the one of headers, the joint member having an upper surface on which a lower end of the receiver tank is assembled; and a bracket for supporting the receiver tank to the one of the headers, wherein the joint member is provided with an inlet flow passage having an inlet side end portion communicated with the condensing portion outlet and an outlet side end portion communicated with the receiver tank inlet and an outlet flow passage having an inlet side end portion communicated with the receiver tank outlet and an outlet side end portion communicated with the subcooling portion inlet, wherein the receiver tank has a pressing stepped portion formed on a periphery of the tank main body, wherein the bracket is provided with a joint portion joined to the periphery of the one of headers and an embracing portion which surrounds the periphery of the tank main body and engages with the pressing stepped portion to downwardly press the receiver tank, and wherein a part of the inlet flow passage extends downward so that an outlet side end portion of the inlet flow passage is arranged at a position lower than a position of the condensing portion outlet.

Since this $11^{th}$ (eleventh) aspect is directed to the refrigeration system utilizing the heat exchanger with a receiver tank according to the $4^{th}$ (fourth) aspect of the present invention, the same functions and effects as mentioned above can be obtained.

The $12^{th}$ (twelfth) aspect of the present invention is directed to the refrigeration system utilizing the heat exchanger with a receiver tank according to the $5^{th}$ (fifth) aspect of the present invention.

In the $12^{th}$ (twelfth) aspect of the present invention, a refrigeration system in which a refrigerant compressed by a compressor is condensed by a heat exchanger with a receiver tank, the condensed refrigerant is decompressed by passing through a decompressing device, and the decompressed refrigerant is evaporated by an evaporator and then returned to the compressor, the heat exchanger with a receiver tank, comprises:

a heat exchanger body including a pair of vertical headers, a plurality of heat exchanging tubes disposed in parallel with each other between the pair of headers with opposite ends of the heat exchanging tube communicated with the headers and a partition provided in the header to group the plurality of heat exchanging tubes into an upper condensing portion and a lower subcooling portion, wherein a condensing portion outlet for flowing out a refrigerant from the condensing portion is provided at a position corresponding to a lower end of the condensing portion of the one of headers, and a subcooling portion inlet for introducing the refrigerant into the subcooling portion is provided at a position corresponding to the subcooling portion of the one of headers;

a slender receiver tank disposed along the one of headers, the receiver tank having a tank main body, a receiver tank inlet and a receiver tank outlet each formed at a lower end of the tank main body and each communicated with an inside of the tank main body;

a joint member joined to the one of headers, the joint member having an upper surface on which a lower end of the receiver tank is assembled;

an inlet flow passage pipe having an inlet side end portion communicated with the condensing portion outlet and an outlet side end portion communicated with the receiver tank inlet; and a bracket for supporting the receiver tank to the one of the headers, wherein the joint member is provided with an outlet flow passage having an inlet side end portion communicated with the receiver tank outlet and an outlet side end portion communicated with the subcooling portion inlet, wherein the receiver tank has a pressing stepped portion formed on a periphery of the tank main body, wherein the bracket is provided with a joint portion joined to the periphery of the one of headers and an embracing portion which surrounds the periphery of the tank main body and engages with the pressing stepped portion to downwardly press the receiver tank, and wherein a part of the inlet flow passage pipe extends downward so that an outlet side end portion of the inlet flow passage pipe is arranged at a position lower than a position of the condensing portion outlet.

Since this $12^{th}$ (twelfth) aspect is directed to the refrigeration system utilizing the heat exchanger with a receiver tank according to the $5^{th}$ (fifth) aspect of the present invention, the same functions and effects as mentioned above can be obtained.

The $13^{th}$ (thirteenth) aspect is directed to the refrigeration system utilizing the heat exchanger with a receiver tank according to the $6^{th}$ (sixth) aspect of the present invention.

In the $13^{th}$ (thirteenth) aspect of the present invention, a refrigeration system in which a refrigerant compressed by a compressor is condensed by a heat exchanger with a receiver tank, the condensed refrigerant is decompressed by passing through a decompressing device, and the decompressed refrigerant is evaporated by an evaporator and then returned to the compressor, the heat exchanger with a receiver tank, comprises:

a heat exchanger body including a pair of headers, a plurality of heat exchanging tubes disposed in parallel with each other between the pair of headers with opposite ends of the heat exchanging tube communicated with the headers and a condensing portion constituted by the heat exchanging tubes, wherein a refrigerant condensed by the condensing portion is made to flow out of a condensing portion outlet of one of the headers;

a slender receiver tank disposed along the one of headers, the receiver tank having a tank main body, a receiver tank inlet and a receiver tank outlet formed at a lower end of the tank main body and communicated with an inside of the tank main body;

a joint member joined to the condensing portion outlet of the one of headers, the joint member having an upper surface on which a lower end of the receiver tank is assembled; and a bracket for supporting the receiver tank to the one of the headers, wherein the joint member is provided with an inlet flow passage having an inlet side end portion communicated with the condensing portion outlet and an outlet side end portion communicated with an receiver tank inlet and an outlet flow passage having an outlet side end portion communicated with the receiver tank outlet, wherein the receiver tank has a pressing stepped portion formed on a periphery of the tank main body, wherein the bracket is provided with a joint portion joined to the periphery of the one of headers and an embracing portion which surrounds the periphery of the tank main body and engages with the pressing stepped portion to downwardly press the receiver tank, and wherein a liquid-stagnating portion for storing a refrigerant is formed between the outlet side end portion of the inlet flow passage in the joint member and the receiver tank inlet.

Since this $13^{th}$ (thirteenth) aspect is directed to the refrigeration system utilizing the heat exchanger with a receiver tank according to the $6^{th}$ (sixth) aspect of the present invention, the same functions and effects as mentioned above can be obtained.

In the $13^{th}$ (thirteenth) aspect of the present invention, the present invention can be preferably adapted to the so-called subcool system condenser having a subcooling portion.

In the $13^{th}$ (thirteenth) aspect of the present invention, it is preferable that an inside of the pair of headers is divided, so that the plurality of the heat exchanging tubes are grouped into the condensing portion and a subcooling portion for subcooling a liquefied refrigerant, wherein the one of headers is provided with a subcooling portion inlet communicated with the subcooling portion, and wherein an outlet side end portion of the outlet flow passage in the joint member is communicated with the subcooling portion inlet.

The $14^{th}$ (fourteenth) aspect is directed to the refrigeration system utilizing the heat exchanger with a receiver tank according to the $7^{th}$ (seventh) aspect of the present invention.

In the $14^{th}$ (fourteenth) aspect of the present invention, a refrigeration system in which a refrigerant compressed by a compressor is condensed by a heat exchanger with a receiver tank, the condensed refrigerant is decompressed by passing through a decompressing device, and the decompressed refrigerant is evaporated by an evaporator and then returned to the compressor, the heat exchanger with a receiver tank, comprises:

a heat exchanger body including a pair of headers, a plurality of heat exchanging tubes disposed in parallel with each other between the pair of headers with opposite ends of the heat exchanging tube communicated with the headers and a condensing portion constituted by the heat exchanging tubes, wherein a refrigerant condensed by the condensing portion is made to flow out of a condensing portion outlet of one of the headers;

a slender receiver tank disposed along the one of headers, the receiver tank having a tank main body, a receiver tank inlet and a receiver tank outlet each formed at a lower end of the tank main body and each communicated with an inside of the tank main body;

a joint member joined to a condensing portion outlet of the one of headers and therearound, the joint member having an upper surface on which a lower end of the receiver tank is assembled; and a bracket for supporting the receiver tank to the one of the headers, wherein the joint member is provided with an inlet flow passage having an inlet side end communicated with the condensing portion outlet and an outlet side end communicated with the receiver tank inlet and an outlet flow passage having an inlet side end portion communicated with the receiver tank outlet, wherein the receiver tank has a pressing stepped portion formed on a periphery of the tank main body, wherein the bracket is provided with a joint portion joined to the periphery of the one of headers and an embracing portion which surrounds the periphery of the tank main body and engages with the pressing stepped portion to downwardly press the receiver tank, and wherein an opening area of the receiver tank inlet is formed to be larger than an opening area of the receiver tank outlet.

Since this $14^{th}$ (fourteenth) aspect is directed to the refrigeration system utilizing the heat exchanger with a receiver tank according to the $7^{th}$ (seventh) aspect of the present invention, the same functions and effects as mentioned above can be obtained.

In the $14^{th}$ (fourteenth) aspect of the present invention, the present invention can be preferably adapted to the so-called subcool system condenser having a subcooling portion.

In the $14^{th}$ (fourteenth) aspect of the present invention, it is preferable that an inside of the pair of headers is divided, so that the plurality of the heat exchanging tubes are grouped into the condensing portion and a subcooling portion for subcooling a liquefied refrigerant, wherein the one of headers is provided with a subcooling portion inlet communicated with the subcooling portion, and wherein an outlet side end portion of the outlet flow passage in the joint member is communicated with the subcooling portion inlet.

Other objects and advantages of the present invention will be apparent from the following preferred embodiments.

BEST MODE FOR CARRYING OUT THE INVENTION

The present invention will be described in detail with reference to the attached drawings.

<First Embodiment>

Figure 1:
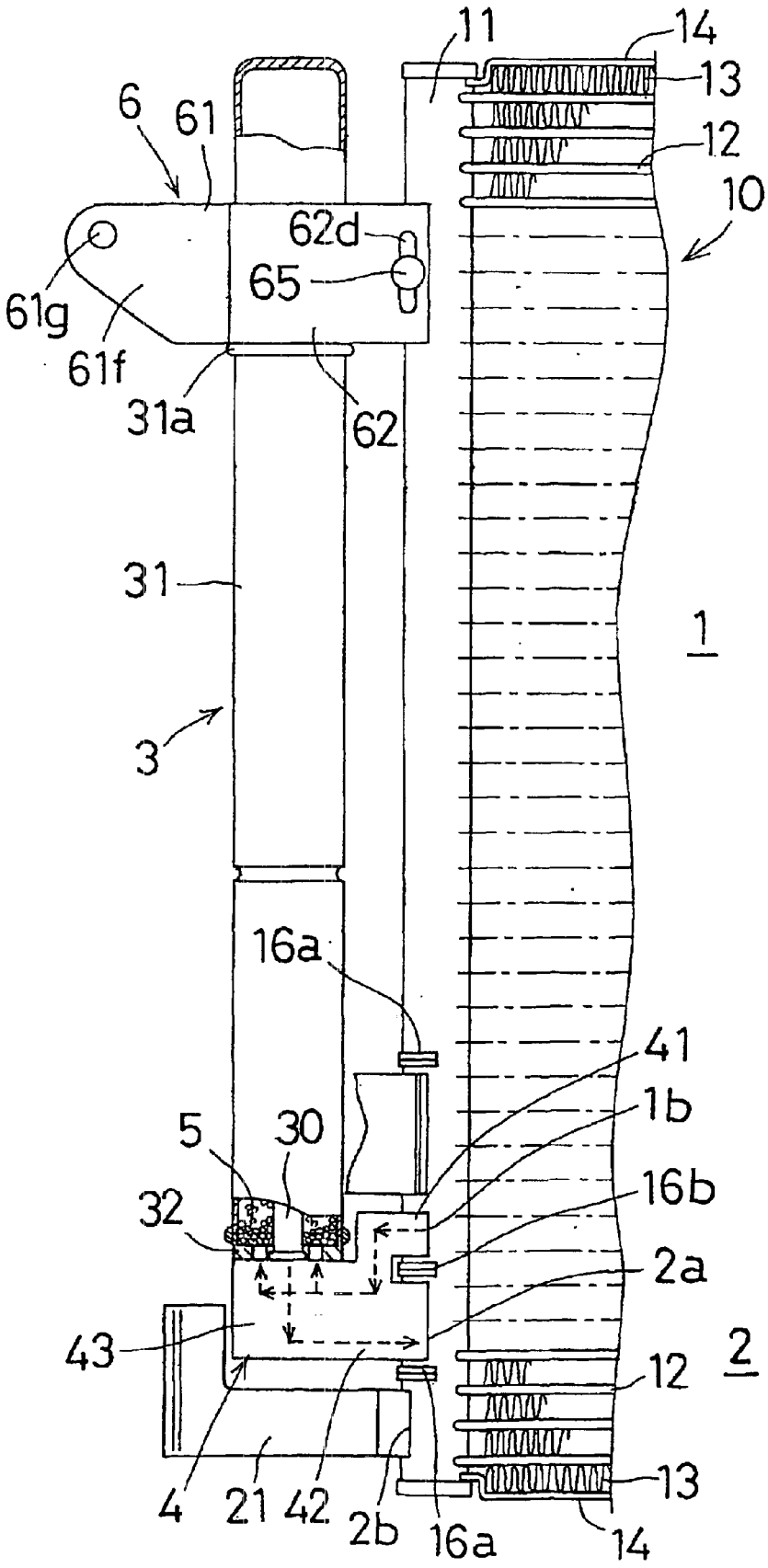
FIG. 1 is a front view showing one side portion of a heat exchanger with a receiver tank according to the first embodiment of the present invention.
Figure 2:
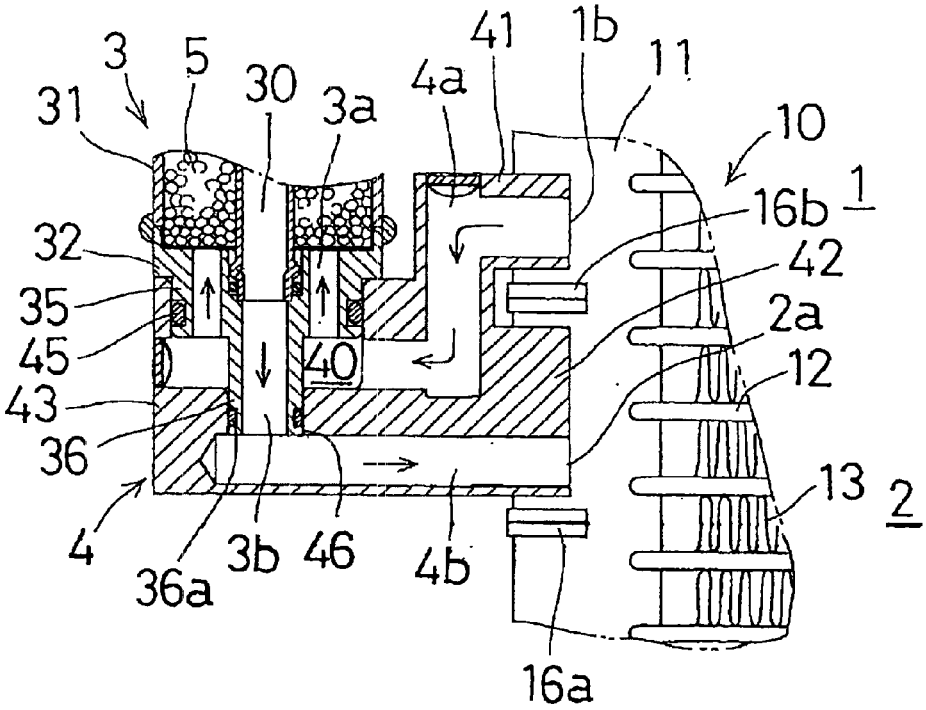
FIG. 2 is an enlarged front cross-sectional view showing a block flange and therearound of the heat exchanger of the first embodiment.
Figure 3:
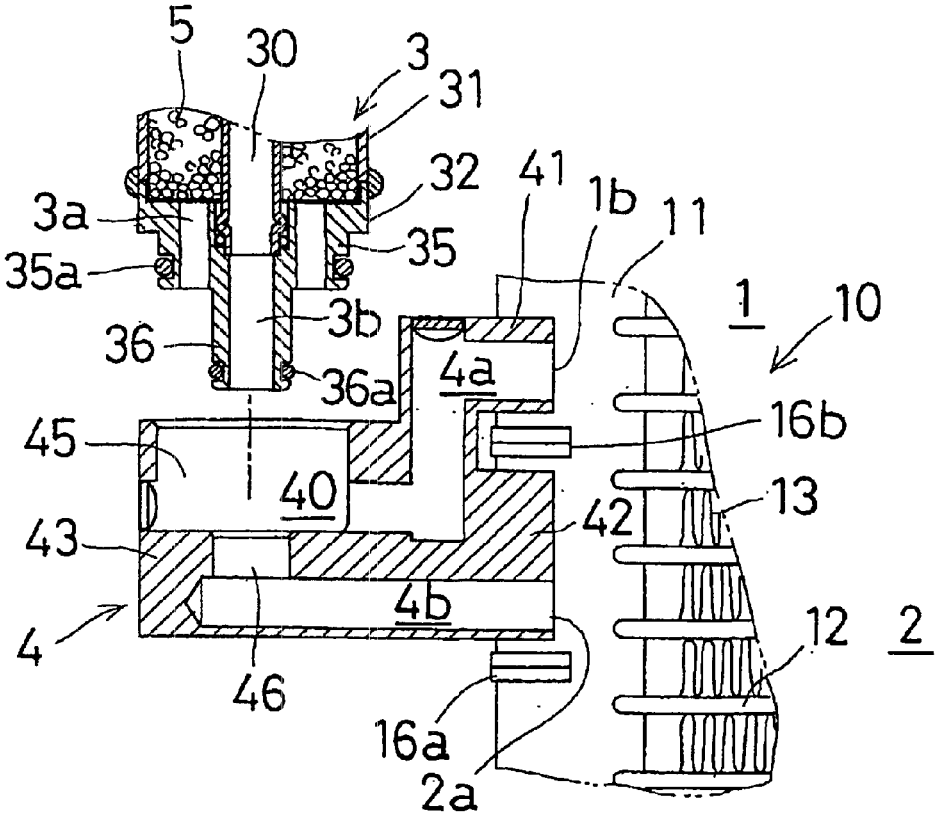
FIG. 3 is a front cross-sectional view showing the block flange from which the receiver tank is detached and therearound according to the first embodiment.

FIG. 1 is a front view showing one side portion of a heat exchanger with a receiver tank according to the first embodiment of the present invention, FIG. 2 is an enlarged partially broken cross-sectional view showing the block flange and therearound of the heat exchanger, and FIG. 3 is a partially broken cross-sectional view showing the block flange and therearound in a disassembled state.

As shown in these figures, this heat exchanger is provided with the so-called multi-flow-type heat exchanger body 10, a receiver tank 3 and a block flange 4 constituting a joint member for joining the receiver tank 3 to the heat exchanger body 10.

The heat exchanger body 10 is provided with a pair of right and left vertical headers 11 disposed at a certain distance. Between this pair of headers 11, a plurality of horizontal flat tubes 12 as heat exchanging tubes are disposed in parallel with each other at certain intervals in a vertical direction with the opposite ends communicated with the headers 11. Furthermore, between the adjacent flat tubes 12 and on the outer surface of the outermost flat tube 12, a corrugated fin 13 is disposed. On the outer surface of the outermost corrugated fin 13, a belt-shaped side plate 14 is disposed.

A pair of partitions 16*b* and 16*b* are provided at the same height within the headers 11 and 11 of the heat exchanger body 10, so that the flat tubes 12 located above the partitions 16*b* and the flat tubes 12 located below the partitions 16*b* are constituted as a condensing portion 1 and a subcooling portion 2 independent from the condensing portion 1, respectively.

Figure 24:
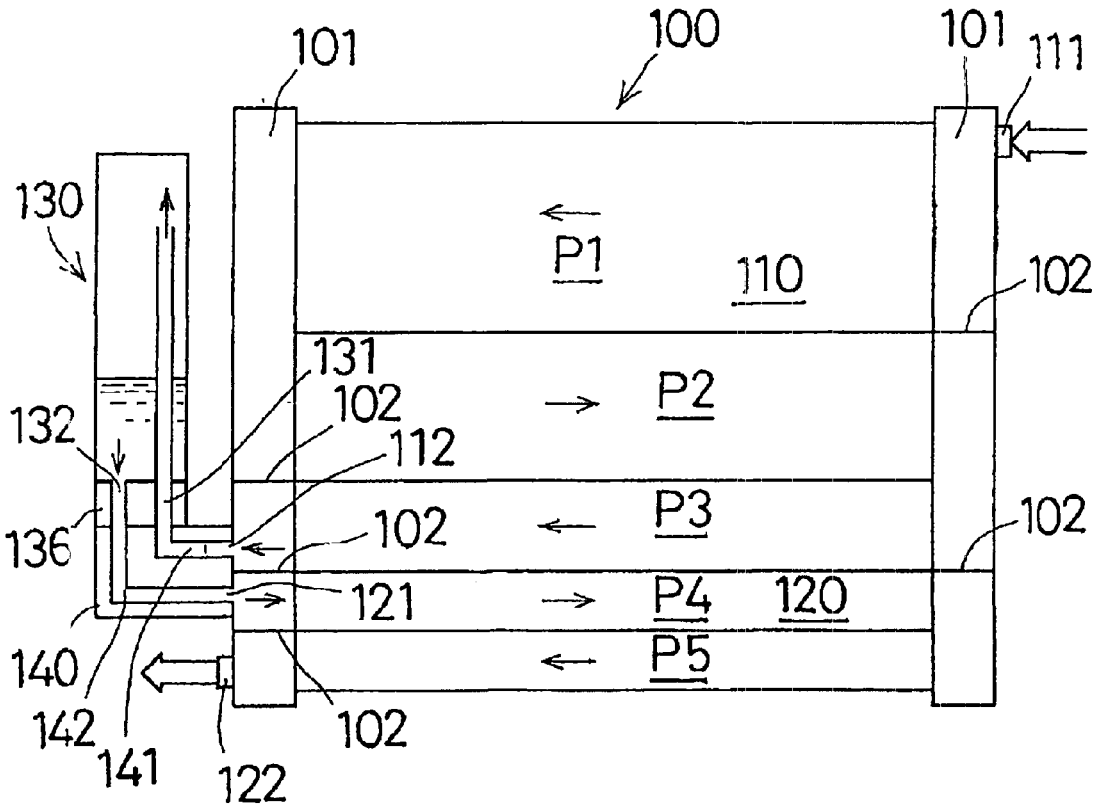
FIG. 24 is a schematic front view showing the refrigerant flow passages in a conventional heat exchanger with a receiver tank.
Figure 25:
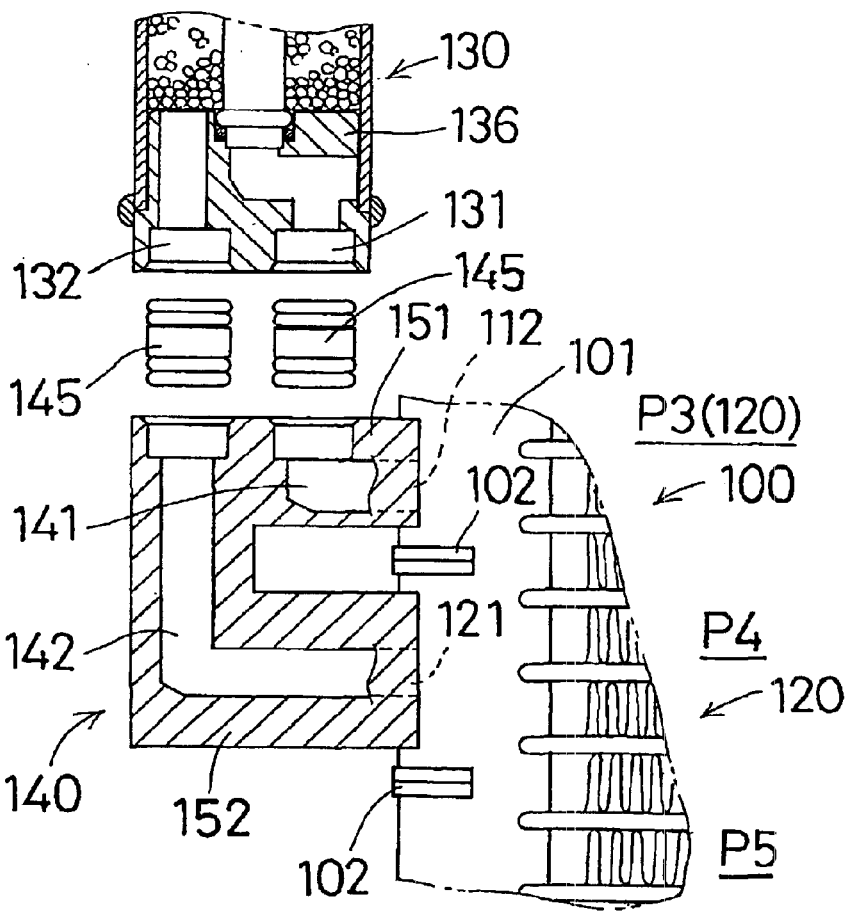
FIG. 25 is a front cross-sectional view showing the block flange and therearound in the conventional heat exchanger with a receiver tank.

Furthermore, each header 11 is provided with partitions 16*a* for grouping the flat tubes 12 constituting the condensing portion 1 into a plurality of passes and partitions 16*a* for grouping the flat tubes 12 constituting the subcooling portion 2 into a plurality of passes. Thus, in the heat exchanger body 10 of this embodiment, in the same manner as in the conventional embodiment shown in FIG. 24, the condensing portion 1 is grouped into three passes, the first pass to the third three pass, and the subcooling portion 2 is grouped into two passes, the fourth pass to the fifth pass.

One of the headers 11 of the heat exchanger body 10, or the left hand header, is provided with a condensing portion outlet 1*b* at a position corresponding to the lower end portion of the condensing portion 1, while the other header (not shown), or the right hand header, is provided with a condensing portion inlet (not shown) at the upper end thereof. Furthermore, the aforementioned one of headers is provided with a subcooling portion inlet 2*a* and a subcooling portion outlet 2*b* at a position corresponding to the upper end of the subcooling portion 2 and a position corresponding to the lower end thereof, respectively. To the subcooling portion outlet 2*b*, an end of an outlet pipe 21 is connected.

The gaseous refrigerant flowed into the heat exchanger body 10 via a condensing portion inlet (not shown) passes through the condensing portion 1 in a zigzag manner, and then flows out of the heat exchanger body 10 via the condensing portion outlet 1*b* of the aforementioned one of headers 11. The gaseous refrigerant is condensed by exchanging heat with the ambient air while passing through the condensing portion 1.

Furthermore, the liquefied refrigerant flowed into the subcooling portion 2 via the subcooling portion inlet 2*a* passes therethrough in a zigzag manner, and then flows out the subcooling portion 2 via the subcooling portion outlet 2*b* and the outlet pipe 21. The liquefied refrigerant is subcooled by exchanging heat with the ambient air while passing through the subcooling portion 2.

The receiver tank 3 is equipped with a tank main body 31 made of an elongated tubular member having a closed upper end, an opened lower end and an inlet-and-outlet forming member 32 attached to the lower-end opening of the tank main body 31 so as to close the opening.

On the upper periphery of the tank main body 31, an outwardly protruded flange-shaped pressing stepped portion 31*a* formed by beading processing is provided (see FIG. 1).

Figure 4A:
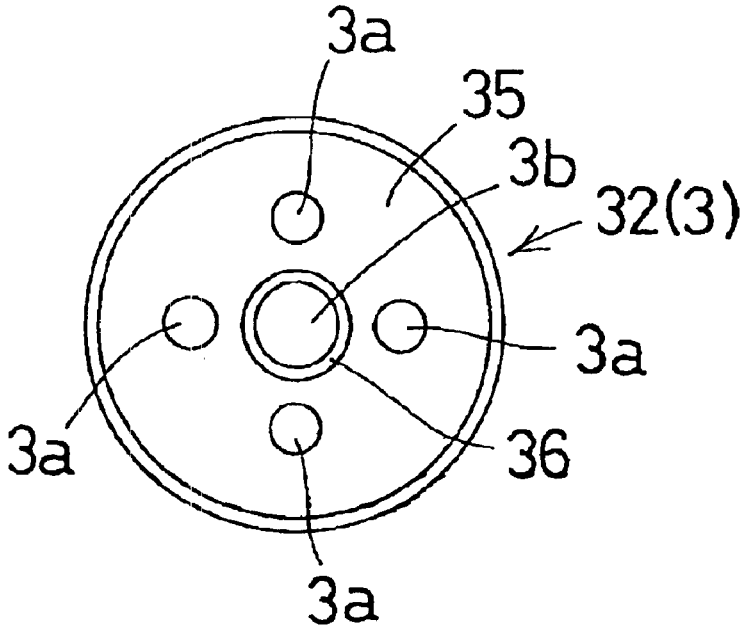
FIG. 4A is a plane view showing an inlet-and-outlet forming member of the receiver tank applied to the heat exchanger of the first embodiment.
Figure 4B:
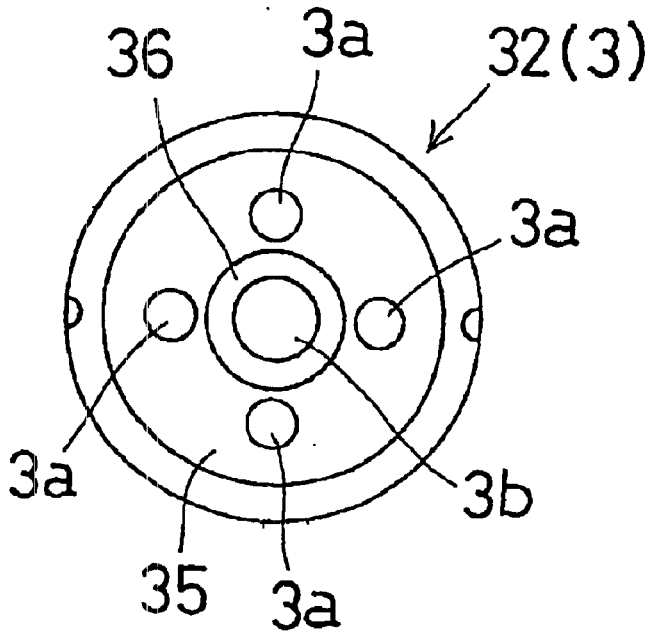
FIG. 4B is the bottom view of the inlet-and-outlet forming member.

As shown in FIGS. 2 to 4, the inlet-and-outlet forming member 32 has a downwardly protruded inlet convex stepped portion 35 at the lower side thereof. This convex stepped portion 35 is circular in horizontal cross-section, and the axial center thereof coincides with the axial center of the receiver tank 3.

Furthermore, on the lower end center of the inlet convex stepped portion 35, a downwardly protruded outlet convex stepped portion 36 is provided. This outlet convex stepped portion 36 is also circular in horizontal cross-section, and the axial center thereof coincides with the axial center of the receiver tank 3.

Furthermore, the inlet convex stepped portion 35 of the inlet-and-outlet forming member 32 is provided with four vertically extended receiver tank inlets 3*a* each communicated with the tank main body 31 formed at certain intervals in a circumferential direction of the inlet convex stepped portion 35 so as to surround the outlet convex stepped portion 36. Furthermore, the outlet convex stepped portion 36 is provided with a receiver tank outlet 3*b* vertically penetrating the outlet convex stepped portion 36 along the axis thereof and communicating with the tank main body 31.

Now, it is constituted that the total opening area of the four receiver tank inlets 3*a* is larger than the opening area of the receiver tank outlet 3*b*.

As shown in FIGS. 1 to 3, in the tank main body 31, a refrigerant suction pipe 30 is vertically arranged with the lower end thereof connected to the inner end of the receiver tank outlet 3*b*. Furthermore, the tank main body 31 is filled up with desiccating agents 5 such as molecular sieves so as to surround the periphery of the refrigerant suction pipe 30. Thus, the inner end of each receiver tank inlet 3*a* is opened at the lower end of the desiccating agents 5, while the upper end of the refrigerant suction pipe 30 is opened above the desiccating agents 5.

In this receiver tank 3, the refrigerant flowed into the tank main body 31 via the inlet ports 3*a* goes upwards through the desiccating agents 5, and the moisture contained in the refrigerant is removed. Thus, the refrigerant is once stored in the tank body 31. Thereafter, only the liquefied refrigerant is sucked from the upper end of the refrigerant suction pipe 30 and goes downwards through the refrigerant suction pipe 30 to be flowed out of the receiver tank outlet 3*b*.

As shown in FIGS. 2 and 3, the block flange 4 is integrally provided with a first block 41 arranged around the condensing portion outlet 1*b*, a second block 42 arranged around the subcooling portion inlet 2*a* and a third block 43 arranged at the lower end of the receiver tank 3. The side surface (joining surface) of the first block 41 is joined to the periphery of the condensing portion outlet 1*b* of the one of the headers 11, while the side surface (joining surface) of the second block 42 is joined to the periphery of the subcooling portion inlet 2*a* of one of the headers 11.

The upper surface of the third block 43 is positioned to be lower than the condensing portion outlet 1*b*, and corresponds to the upper portion of the subcooling portion 2. In the upper surface of the third block 43, an inlet concave stepped portion 45 circular in horizontal cross-section and capable of fitting the inlet convex stepped portion 35 of the receiver tank 3 is formed. Furthermore, in the bottom surface of the inlet concave stepped portion 45, an outlet concave stepped portion 46 circular in horizontal cross-section and capable of fitting the outlet convex stepped portion 36 of the receiver tank 3 is formed.

The block flange 4 is provided with an inlet flow passage 4*a* connecting the condensing portion outlet 1*b* to the receiver tank inlets 3*a* and an outlet flow passage 4*b* connecting the receiver tank outlet 3*b* to the subcooling portion inlet 2*a*.

The inlet flow passage 4*a* has one end opened to the joining surface of the first block 41 and communicated with the condensing portion outlet 1*b*, a downwardly extended intermediate portion and the other end opened to the inner peripheral lower end of the inlet concave stepped portion 45 of the third block 43. The other end opening of the inlet flow passage 4*a* is positioned at the lower end of the inlet concave stepped portion 45. This position is lower than the position of the condensing portion outlet 1*b*, and corresponds to the upper portion of the subcooling portion 2.

On the other hand, the one end of the outlet flow passage 4*b* is opened to the joining surface of the second block 42 and communicated with the subcooling portion inlet 2*a*, while the other end thereof is opened to the bottom surface of the outlet concave stepped portion 46.

Into the inlet and outlet concave stepped portions 45 and 46 of this block flange 4, the inlet and outlet convex stepped portions 35 and 36 of the receiver tank 3 are fitted. On the external periphery of the inlet and outlet convex stepped portion 35 and 36, sealing rings 35*a* and 36*a* such as O-rings are provided. The sealing ring 36*a* makes air-tightness between the outlet concave stepped portion 46 and the inlet concave stepped portion 45, while the sealing ring 35*a* makes air-tightness between the inlet concave stepped portion 45 and the exterior.

Furthermore, at the bottom of the inlet concave stepped portion 45, a gap is provided between the bottom surface and the lower end of the receiver tank inlets 3*a*. The gap constitutes a liquid stagnating portion 40.

On the other hand, the bracket 6 for attaching the upper part of the receiver tank 3 to one of the headers 11 has a bracket main body 61 and one side embracing member 62.

Figure 5:
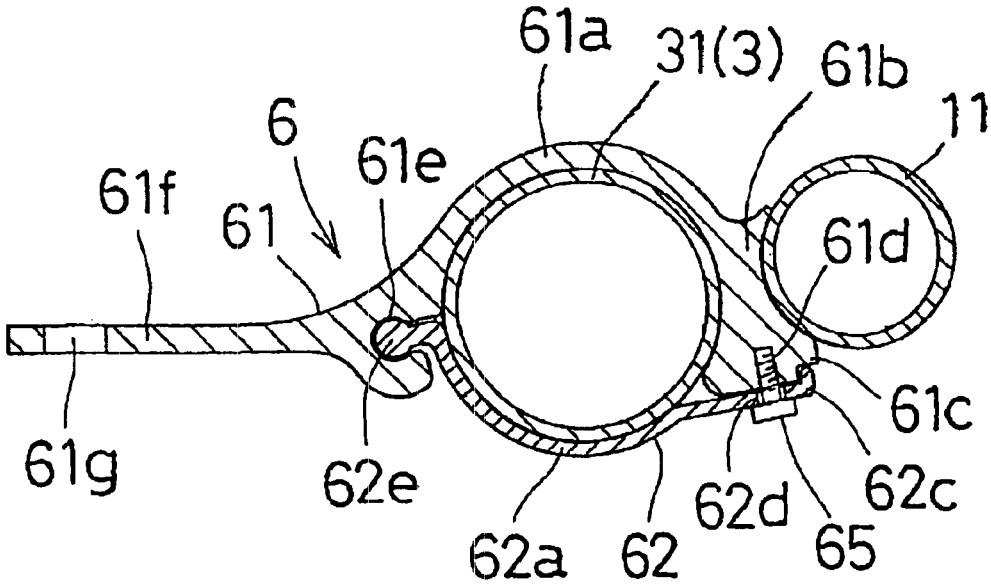
FIG. 5 is a horizontal cross-sectional view showing the bracket of the heat exchanger and therearound according to the first embodiment.
Figure 6:
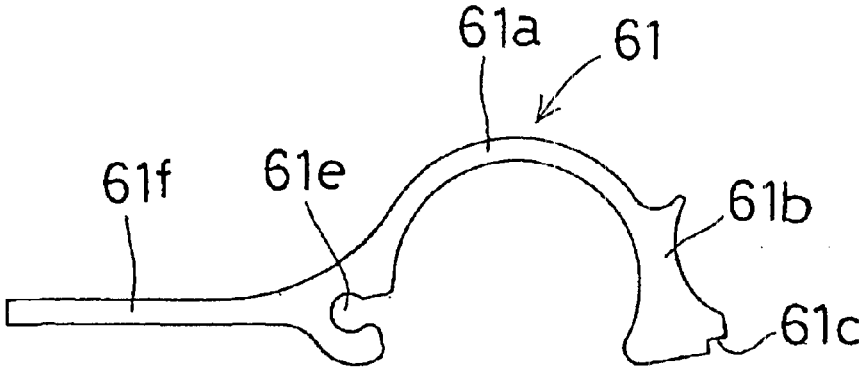
FIG. 6 is a plane view showing the bracket main body of the bracket applied to the first embodiment.
Figure 7:
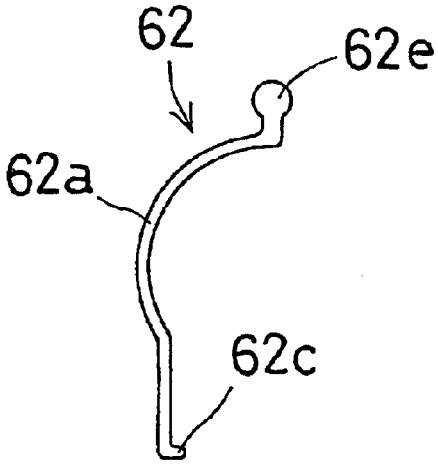
FIG. 7 is a plane view showing the one side embracing member constituting the bracket of the first embodiment.

As shown in FIGS. 5 to 7, the bracket main body 61 is provided with an embracing portion 61*a* semicircular arc in cross-section and capable of fitting on the half periphery of the tank main body 31 of the receiver tank 3. At the one end of this embracing portion 61*a*, a joint portion 61*b* capable of fitting on the external surface of the one of the headers 11 of the heat exchanger body 10 is provided. Furthermore, at the end portion of the joint portion 61*b*, an engaging stepped portion 61*c* is formed. In the end surface of the joint portion 61*b*, a screw hole 61*d* is formed. On the other hand, at the other end of the embracing portion 61*a*, an axis holding groove 61*e* extending along the longitudinal direction of the receiver tank 3 is formed. Furthermore, at the other end of the embracing portion 61*a*, a fixing member 61*f* extending sideways is provided. An attaching hole 61*g* is formed in the tip portion of the fixing member 61*f*.

This bracket main body 61 is fixed to the one of the headers 11 by brazing the joint portion 61*b* to the periphery of the one of the headers 11 of the heat exchanger main body 10 in a state that the embracing portion 61*a* is disposed at the upper portion of the flange shaped pressing stepped portion 31*a* of the tank main body 31 of the receiver tank 3 so as to cover the rear half of the periphery of the tank main body 31.

On the other hand, the aforementioned one side embracing member 62 is provided with an embracing portion 62*a* corresponding to the embracing portion 61*a* of the bracket main body 61 which is semicircular in cross-section and capable of fitting to the remaining half periphery of the tank main body 31. At one end of this embracing portion 62*a*, an engaging protrusion 62*c* capable of engaging with the engaging stepped portion 61*c* of the bracket main body 61 and a vertically extended elongated screw insertion slot 62*d* corresponding to the screw hole 62*d* of the bracket main body 61 as shown in FIGS. 1 and 5 are formed. On the other hand, at the other end of the embracing member 62, a vertically extending axial portion 62*e* capable of rotatably inserting into the axis holding groove 61*e* of the bracket main body 61 is formed.

This axial portion 62*e* of the embracing member 62 is inserted into the axis holding groove 61*e* of the bracket main body 61 from the end thereof. Thus, the embracing member 62 is attached to the bracket main body 61 so that the embracing member 62 is vertically slidable and rotatable about the axial portion 62*e* as a fulcrum. Then, the one side embracing member 62 is fitted to the front half periphery of the tank main body 31 by rotating the one side embracing member 62 about the axial portion 62*e* as a fulcrum. Thereafter, in this state, the one side embracing member 62 is fixed to the bracket main body 61 by inserting the screw 65 through the screw insertion slot 62*d* and tightening it in the screw insertion hole 62*d*.

In the bracket 6 attached to the tank main body 31 as mentioned above, as shown in FIG. 1, the embracing portions 61*a* and 62*a* engage with the upper surface of the flange shaped pressing stepped portion 31*a* of the tank main body 31, to thereby downwardly press the tank main body 31.

The aforementioned heat exchanger with a receiver tank is used as a condenser for automobile air-conditioning refrigeration systems together with a compressor, decompressing means and an evaporator. In this refrigeration cycle, the gaseous refrigerant of high temperature high and high pressure compressed by the compressor is introduced into the condensing portion 1 via the condensing portion inlet (not shown) and passes therethrough. The refrigerant is condensed by exchanging heat with the ambient air, and then flows out of the condensing portion 1 through the condensing portion outlet 1*b*.

The refrigerant introduced from the condensing portion outlet 1*b* is introduced to the inlet concave stepped portion 45 through the inlet flow passage 4*a* of the block flange 4, and forms a liquid stagnation at the bottom of the concave stepped portion 45 constituting the liquid stagnating portion 40. The stored liquefied refrigerant is introduced into the tank main body 31 through the receiver tank inlets 3*a*, and passes through the desiccating agents 5. After the moisture is removed, the refrigerant is once stored in the tank main body 31. Only the liquefied refrigerant is sucked from the upper end of the refrigerant suction pipe 30 and goes downward through the refrigerant suction pipe 30. Then, the refrigerant flows out of the tank main body 31 from the receiver tank outlet 3*b*.

The liquefied refrigerant flowed out from the receiver tank outlet 3*b* passes through the outlet flow passage 4*b* of the block flange 4 to be introduced into the subcooling portion 2 through the subcooling portion inlet 2*a* of the heat exchanger body 10.

The liquefied refrigerant introduced in the subcooling portion 2 is subcooled by the ambient air while passing through the subcooling portion 2. Thereafter, the refrigerant is flowed out of the subcooling portion 2 via the subcooling portion outlet 2*b* and the outlet pipe 21, and then passes through the decompressing means, the evaporator and the compressor in this order. In this way, the refrigerant circulates in the refrigeration cycle.

As mentioned above, according to the heat exchanger with a receiver tank of this embodiment, since the flange shaped pressing stepped portion 31*a* is formed on the upper periphery of the receiver tank 3 and is downwardly pressed by the bracket 6 fixed to one of the headers 11, the inlet-and-outlet forming member 32 of the receiver tank 3 can be assuredly connected to the block flange 4 without using screws. Accordingly, it is not necessary to increase the thickness of the inlet-and-outlet forming member 32 for securing screws. Furthermore, it is possible to decrease the size and weight while increasing the tank volume. Accordingly, the stability range in the subcooling state of the refrigerant can be increased, and the excess and shortage of the sealed amount of the refrigerant can be prevented. The sealed amount of the refrigerant can be set up in an optimal condition, and the stable refrigeration performance can be obtained.

Furthermore, troublesome screw tightening operations also become unnecessary, which enables easy assembling operation of the receiver tank 3.

Furthermore, in this embodiment, the bracket main body 61 of the bracket 6 is disposed so as to fit on the one half of the periphery of the receiver tank 3, and the other end axial portion 62*e* of the one side embracing member 62 to be fitted on the remaining semicircular peripheral portion of the receiver tank 3 is vertically and slidably attached to the bracket main body 61. Then, a screw 65 is inserted into the vertically elongated screw insertion slot 62*d* formed in the end of the one side embracing member 62 and tightened to the bracket main body 61. Accordingly, the so-called rocket phenomenon that the receiver tank 3 jumps out upwards due to the refrigerant pressure at the time of removing the receiver tank can be prevented. That is, since the refrigerant is sealed in the receiver tank 3 under high pressure, the releasing of the downward pressing of the receiver tank 3 by loosening the screw 65 causes a vigor blowing of the refrigerant gas through the receiver tank inlet-and-outlet 3*a* and 3*b*, which in turn causes an upward jump of the receiver tank 3. However, in this embodiment, since the screw insertion slot 62*d* is formed into a vertically elongated shape, when the one side embracing member 62 is about to jump out upwards together with the receiver tank 3, the receiver tank 3 is raised a little until the screw 65 engages with the lower end of the screw insertion slot 62*d*. Accordingly, the unexpected jump of the receiver tank 3 can be prevented. Furthermore, since the connection of the receiver tank 3 to the block flange 4 is released when the receiver tank 3 is raised slightly and therefore the receiver tank inlet-and-outlet 3*a* ad 3*b* is opened to the outside, the deflation can be performed automatically. Accordingly, the receiver tank 3 can be detached by removing the screw 65, which enables an efficient maintenance, checking, or the like.

Furthermore, in this embodiment, two convex stepped portions 35 and 36 formed at the inlet-and-outlet forming member 32 of the receiver tank 3 are inserted into two concave stepped portions 45 and 46 formed in the receiver tank attaching portion of the block flange 4. Accordingly, by simply inserting the convex stepped portions 35 and 36 into two concave stepped portions 45 and 46, the attaching of the receiver tank 3 to the block flange 4 can be performed more easily with accuracy.

Furthermore, since it is constituted such that the axial center of the convex stepped portions 35 and 36 coincides with the axial center of the receiver tank 3, the receiver tank 3 can be attached to the block flange 4 without difficulty even if the receiver tank 3 is rotated relative to the block flange 4 at either rotational direction about the axis. Therefore, the positioning of the receiver tank 3 by rotating in a certain direction about the axis also becomes unnecessary, resulting in easier assembling operation.

Furthermore, since the plurality of receiver tank inlets 3*a* of the inlet convex stepped portion 35 are formed at certain intervals in the circumferential direction, even if the receiver tank 3 is arranged at either rotational position, the refrigerant passes through the plurality of receiver tank inlets 3*a* and introduced into the tank main body 31 in a circumferentially distributed manner. Therefore, the liquefied refrigerant is introduced into the tank main body 31 efficiently and stably, resulting in efficient bubble extinguishing. Accordingly, it is possible to assuredly decrease the amount of refrigerant and stably supply the liquefied refrigerant, which in turn results in stable operation of the refrigeration cycle, enhanced performance and miniaturization of the entire refrigeration system.

Furthermore, since the inner end of the receiver tank inlets 3*a* are opened at the lower end of the desiccating agents 5 and that the upper end of the refrigerant suction pipe 30 connected to the receiver tank outlet 3*b* is opened above the desiccating agents 5, the refrigerant flowed into via the receiver tank inlet 3*b* is prevented from being biased due to the rectification when passing through the desiccating agents 5. As a result, the refrigerant slowly goes up through the desiccating agents 5 evenly, which smoothly extinguish bubbles. Accordingly, only the liquefied refrigerant can be assuredly extracted through the refrigerant suction pipe 30. Thus, a stable supply of liquefied refrigerant can be performed assuredly, which enables to further enhance the performance of the entire refrigeration system.

Figure 8A:
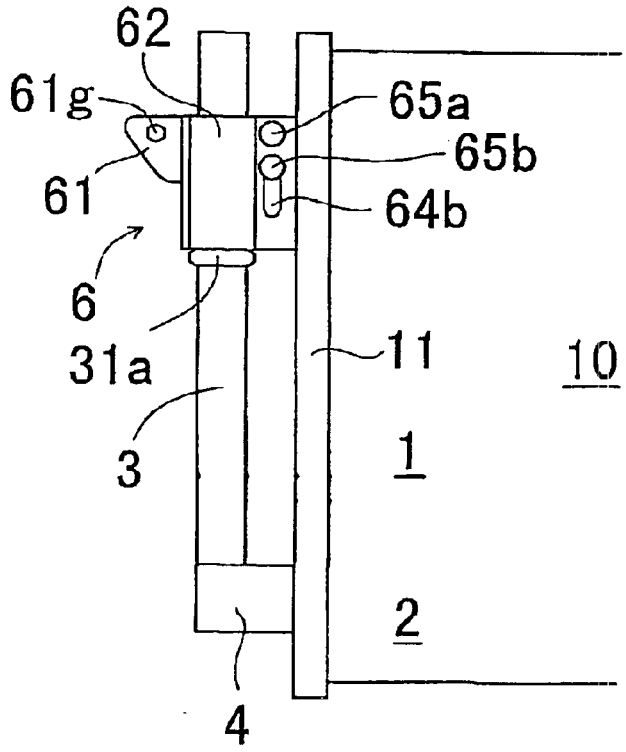
FIG. 8A is a front view showing one side portion of a heat exchanger with a receiver tank which is a first modification of the present invention.
Figure 8B:
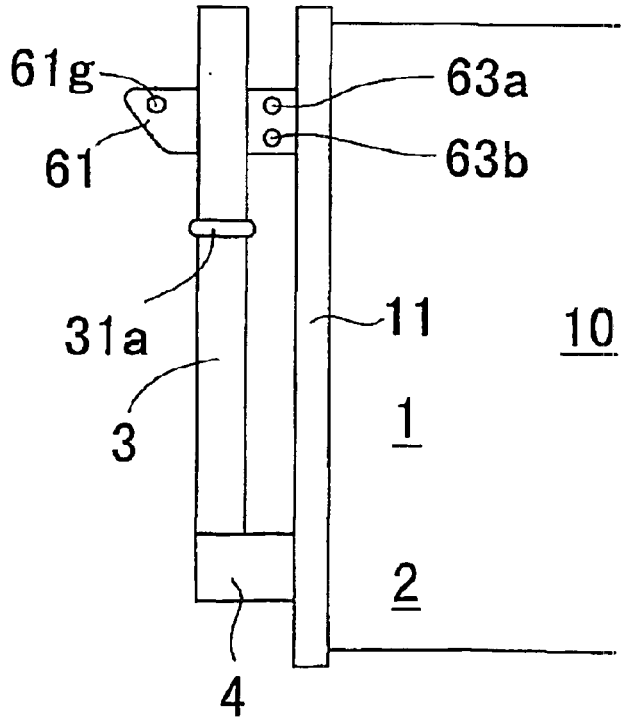
FIG. 8B is a front view showing the one side portion of the heat exchanger of the first modification in a state that the one side embracing member is removed.
Figure 9A:
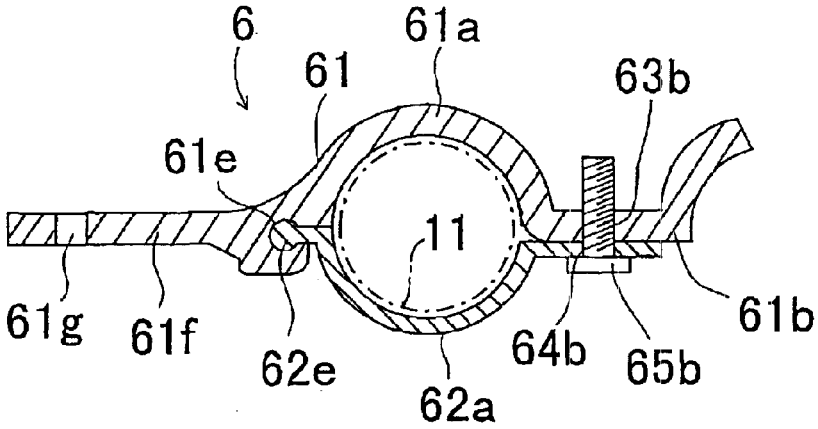
FIG. 9A is a horizontal cross-sectional view showing the bracket applied to the heat exchanger of the first modification.
Figure 9B:
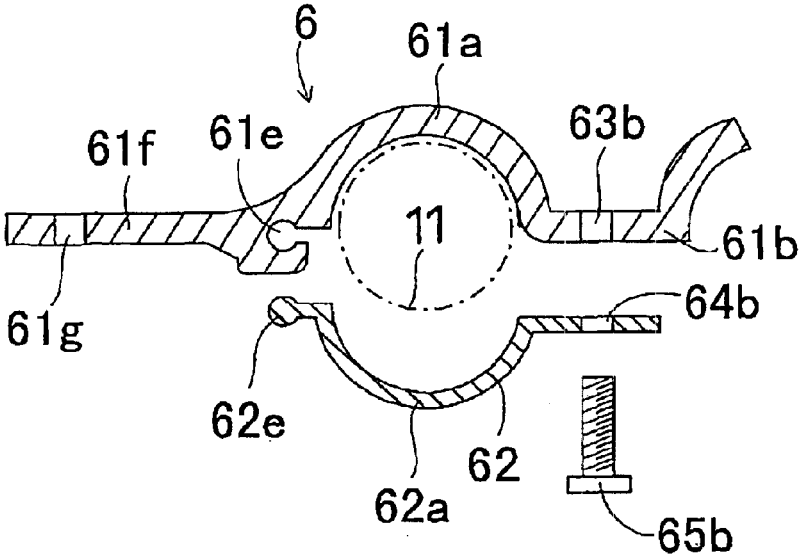
FIG. 9B is a horizontal cross-sectional view showing the bracket of the first modification in a disassembled state.
Figure 10:
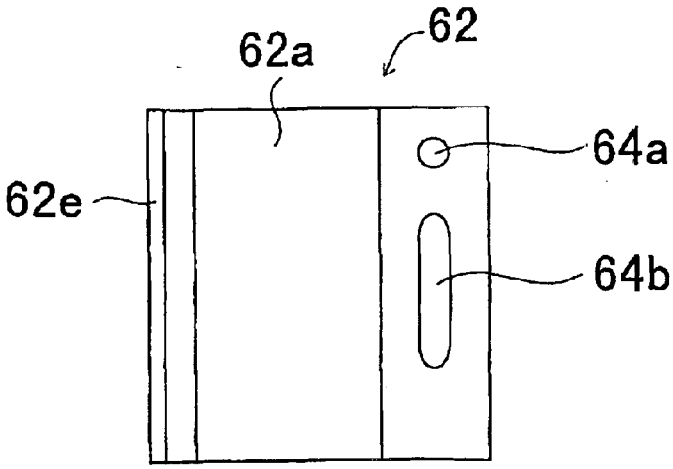
FIG. 10 is a front view showing the one side embracing member applied to the bracket of the first modification.

FIGS. 8 to 10 show a first modification of the present invention. As shown in these figures, in this heat exchanger with a receiver tank, the bracket 6 for supporting the receiver tank 3 is different from that of the aforementioned embodiment.

That is, the joint portion 61*b* of the bracket main body 61 is provided with two screw holes, or an upper screw hole 63*a* and a lower screw hole 63*b*.

Furthermore, at the end portion of the one side embracing member 62, screw insertion holes 64*a* and 64*b* corresponding to the screw holes 63*a* and 63*b* of the aforementioned bracket main body 61 are provided. The upper screw insertion hole 64*a* is formed into a round shape, while the lower screw insertion hole 64*b* is formed into a vertical elongated slot-like shape.

This axial portion 62*e* of the embracing member 62 is inserted into the axis holding groove 61*e* of the bracket main body 61 from the end thereof. Thus, the embracing member 62 is attached to the bracket main body 61 so that the embracing member 62 is vertically slidable and rotatable about the axial portion 62*e* as a fulcrum. Then, the one side embracing member 62 is fitted to the front half periphery of the tank main body 31 by rotating the one side embracing member 62 about the axial portion 62*e* as a fulcrum. Thereafter, in this state, the one side embracing member 62 is fixed to the bracket main body 61 by inserting the screws 65*a* and 65*b* through the screw insertion holes 64*a* and 64*b* and tightening them in the screw insertion holes 63*a* and 63*b*.

Since the other structures are substantially the same as those of the aforementioned first embodiment, the same reference numeral is allotted to the same portion, and the duplicate explanation will be omitted.

In this heat exchanger with a receiver tank of this first modification, since the one side embracing member 62 is fixed to the bracket main body 61 with two screws 65*a* and 65*b*, the so-called rocket phenomenon that the receiver tank 3 jumps upward vigorously can be prevented assuredly even if one of the screws is unexpectedly dropped out at the time of the maintaining or checking the receiver tank 3, etc.

Furthermore, since the lower screw insertion hole 64*b* is formed into an elongated slot-like shape, by removing the upper screw 65*a* first at the time of the receiver tank maintenance check, the screw 65*b* engages with the lower end of the screw insertion slot 64*b* when the one side embracing member 62 jumps upwards together with the receiver tank 3. Accordingly, the receiver tank 3 is allowed to go upward a little, which prevents an unexpected jump of the receiver tank 3. Furthermore, when the receiver tank 3 jumps upward a little, the connection of the receiver tank 3 to the block flange 4 is released and therefore the receiver tank inlet-and-outlet 3*a* and 3*b* is opened to the outside. Accordingly, the deflation is performed, thereby falling the internal pressure. Thus, since the deflation can be performed automatically, by removing the screw 65*b* later, the receiver tank 3 can be removed without difficulty, and therefore the maintenance or check thereof can be performed smoothly and efficiently.

Figure 11:
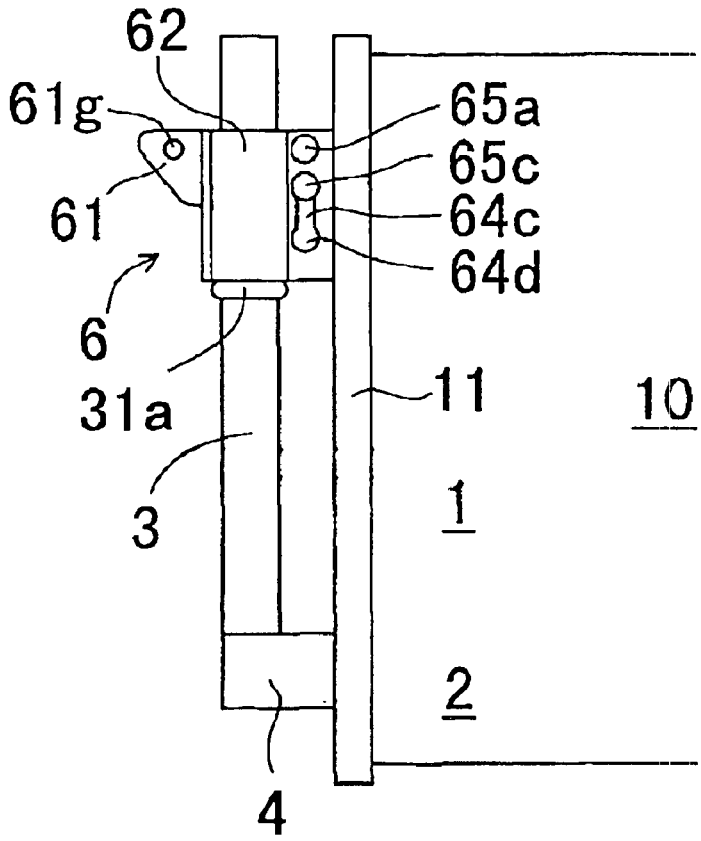
FIG. 11 is a front view showing one side portion of a heat exchanger with a receiver tank which is a second modification of the present invention.
Figure 12A:
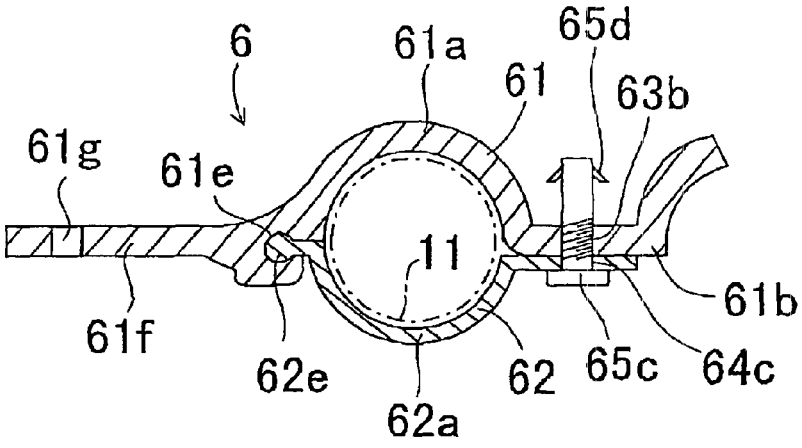
FIG. 12A is a horizontal cross-sectional view showing the bracket applied to the heat exchanger of the second modification.
Figure 12B:
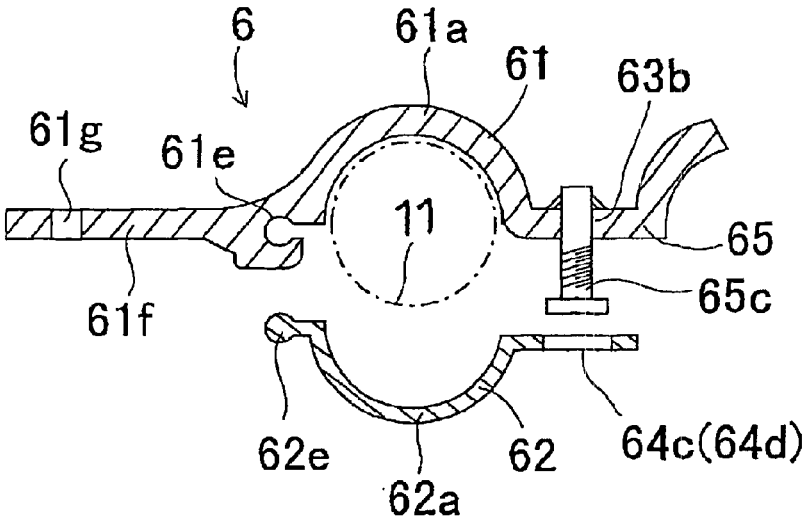
FIG. 12B is a horizontal cross-sectional view showing the bracket of the second modification in a disassembled state.
Figure 13:
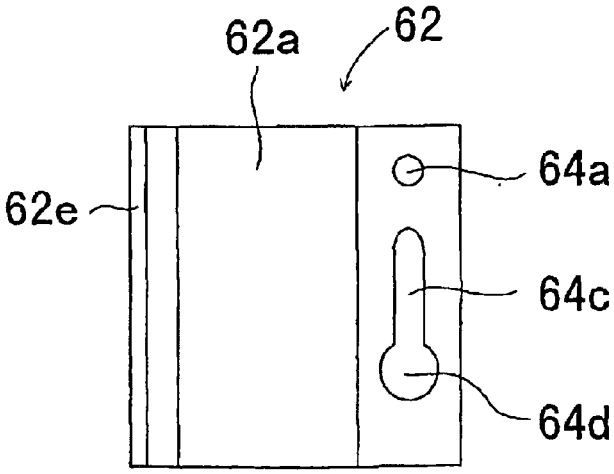
FIG. 13 is a front view showing the one side embracing member applied to the bracket of the second modification.

FIGS. 11 to 13 show the second modification of the present invention. As shown in these figures, the upper screw insertion hole 64*a* formed in one side embracing member 62 of the receiver tank 3 in this heat exchanger with a receiver tank is formed into a round shape, and the lower screw insertion hole 64*c* is formed into a vertically extended elongated slot-like shape having a large screw head insertion portion 64*d* at the lower end of the screw insertion hole 64*c*.

Figure 14A:
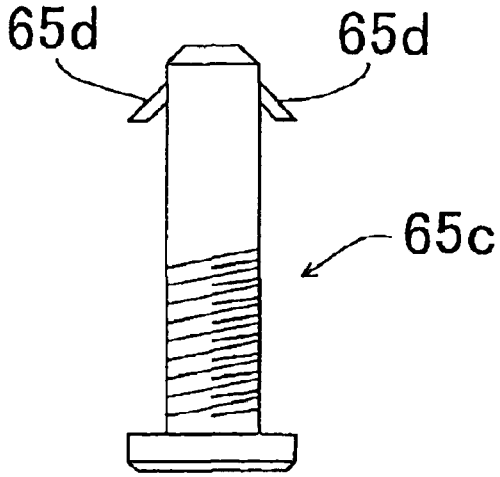
FIG. 14A is a plane view showing a lower bolt applied to the bracket of the second modification.

As for the screw 65*a* to be inserted into the upper screw insertion hole 64*a*, a general-purpose screw is used in the same manner as in the aforementioned embodiment. To the contrary, as for the lower screw 65*c*, a synthetic resin screw having pull-out-preventing portions 65*d* capable of decreasing the diameter at the tip end thereof is used as shown in FIG. 14A. Before fixing the one side embracing member 62 to the bracket main body 61 with screws, the lower screw 65*c* is inserted into the lower screw hole 63*b* of the bracket main body 61 in advance. That is, the screw 65*c* is inserted into the lower screw hole 63*b* while elastically deforming the pull-out-preventing portion 65*d* so as to reduce the diameter. Thereafter, the pull-out-preventing portion 65*d* is made to elastically restore into the diameter expansion state. Thus, the pull-out-preventing portion 65*d* is made to engage with the rear side of the peripheral portion of the screw hole 63*b* and the screw 65*c* is disposed in the screw hole 63*b* in a pull-out-prevented state.

Thereafter, the axial portion 62*e* of the one side embracing member 62 is inserted into the axis holding groove 61*e* of the bracket main body 61. Then, the one side embracing member 62 is rotated about the axial portion 62*e* as a fulcrum so as to fit on the front half of the periphery of the tank main body 31. At this time, the lower screw 65*c* is inserted into the lower screw insertion slot 64*c* of the one side embracing member 62 by inserting the head of the lower screw 65*c* to be held at the bracket main body 61 into the screw-head insertion portion 64*d* of the lower screw insertion slot 64*c* of the one side embracing member 62.

Then, the upper screw 65*a* is inserted into the screw insertion hole 64*a* and tightened in the screw hole 63*a*, while the lower screw 65*c* is tightened in the lower screw 63*b*, thereby fixing the one side embracing member 62 to the bracket main body 61.

The other structures are the same as those of the first embodiment and the first modification.

In the heat exchanger with a receiver tank of this second modification, in the same manner as in the first modification, the rocket phenomenon can be effectively prevented and the maintenance or check of the receiver tank 3 can be performed smoothly and efficiently.

Moreover, since the lower screw 65*c* is arranged so as not to be pulled out from the bracket main body 61, it is possible to more assuredly prevent the lower screw 65*c* from being pulled out. Therefore, the rocket phenomenon due to the pulled-out-screw can be prevented more assuredly.

Here, in this second modification, the structure of the lower screw 65*c*, especially the structure of the pull-out-preventing portion 65*d*, is not limited to a specific one, but may be various structure so long as it is possible to be disposed in the lower screw hole 63*b* in a pull-out-prevented state.

Figure 14B:
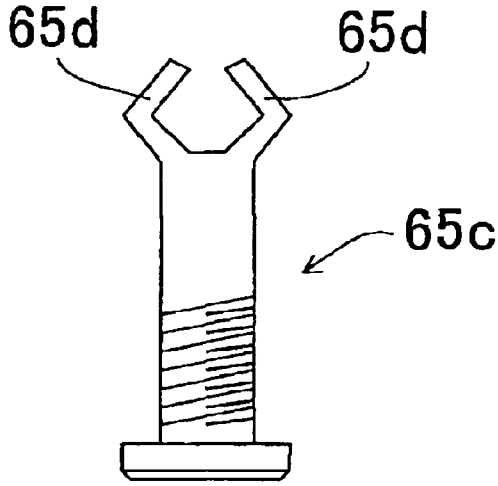
FIG. 14B is a plane view showing another lower bolt applied to the bracket of the second modification.

For example, as shown in FIG. 14B, the screw 65*c* provided with pull-out-preventing portions 65*d* capable of elastically reducing the diameter at the tip end thereof may be used.

The same effects as mentioned above can be obtained not only when the first and second modifications are applied to the aforementioned first embodiment but also when they are applied to the following embodiments and their modifications.

<Second Embodiment>

FIGS. 15 to 18 are enlarged views showing the block flange and therearound of the heat exchanger with a receiver tank according to the second embodiment of the present invention.

As shown in these figures, in this heat exchanger, at both sides of the outlet convex stepped portion 36 of the inlet-and-outlet forming member 32 of the receiver tank 3, a pair of pull-out-preventing projections 37 and 37 protruded sideways are formed.

On the other hand, at the inner periphery of the outlet concave stepped portion 46 of the block flange 4, a projection engaging slot 47*b* is formed along the circumferential direction thereof. Furthermore, at the peripheral portion of the outlet concave stepped portion 46 on the bottom surface of the inlet concave stepped portion 45, projection introducing notches 47*a* corresponding to the aforementioned pull-out-preventing projections 37 and extending along the axial direction are formed. The upper end of the projection introducing notch 47*a* is opened to the bottom surface of the inlet concave stepped portion 45, and the lower end thereof is communicated with the projection engaging slot 47*b*.

Figure 15:
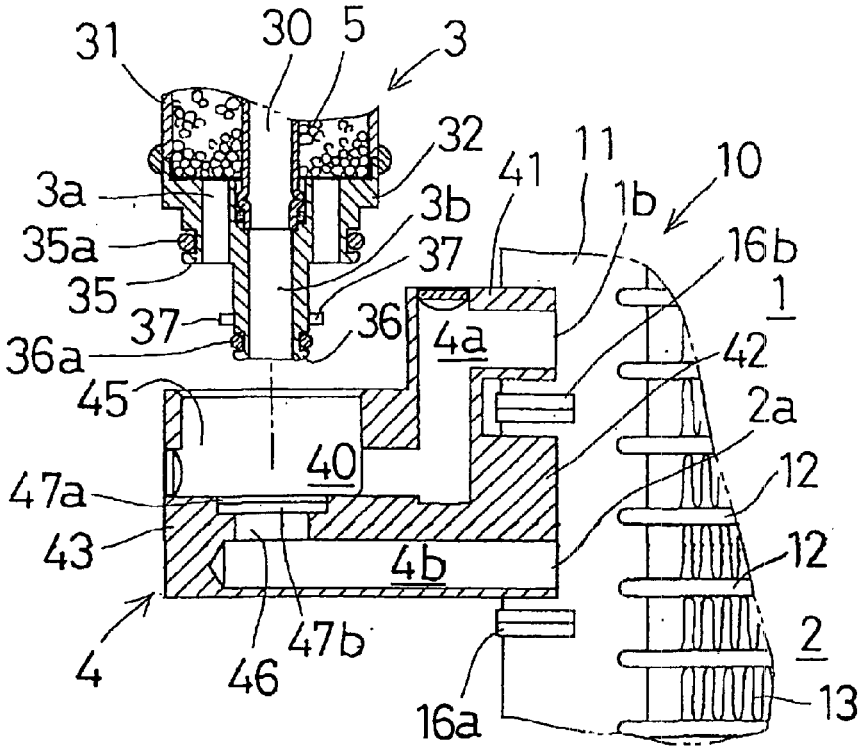
FIG. 15 is a front cross-sectional view showing the block flange of the heat exchanger with a receiver tank according to the second embodiment of the present invention from which the receiver tank is detached.
Figure 16:
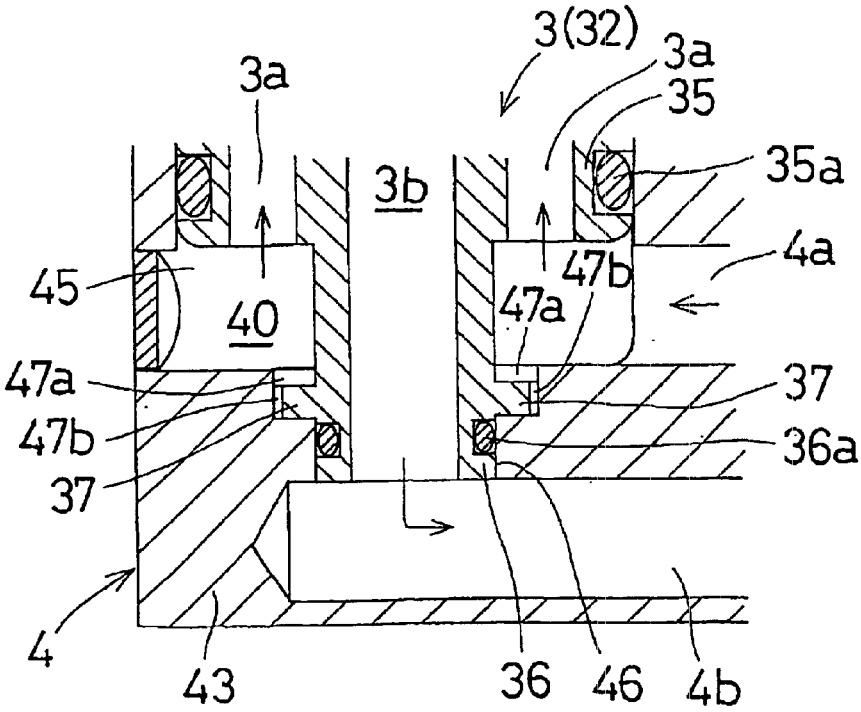
FIG. 16 is an enlarged front cross-sectional view showing the connecting portion between the receiver tank and the block flange of the second embodiment.
Figure 17:
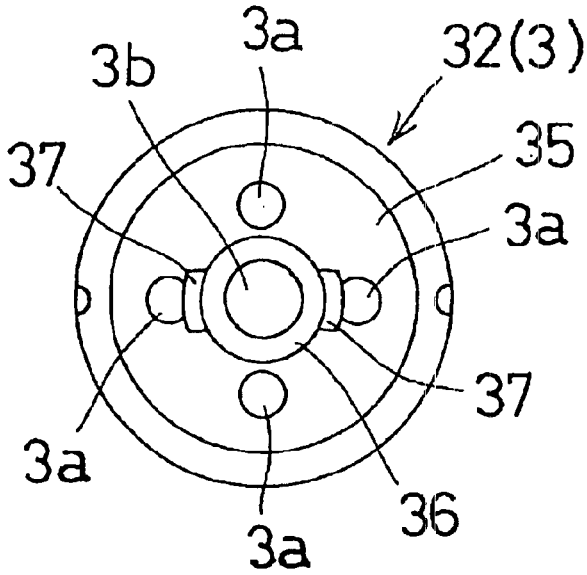
FIG. 17 is a bottom view showing the inlet-and-outlet forming member applied to the receiver tank of the second embodiment.
Figure 18:
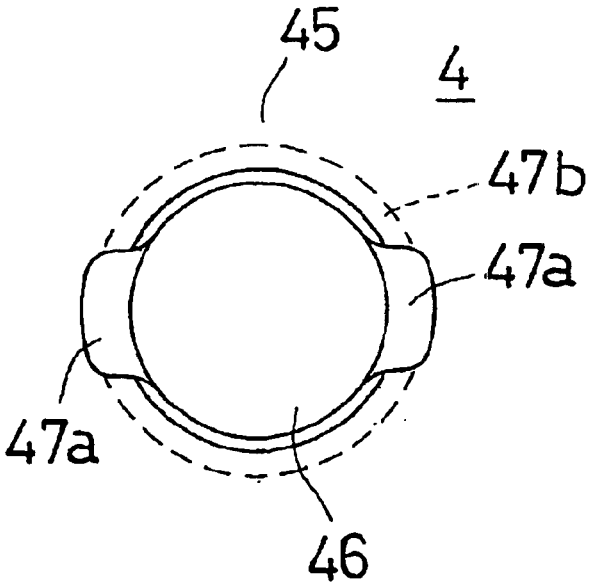
FIG. 18 is a plane view showing the bottom surface of the outlet concave stepped portion in the block flange of the second embodiment.
Figure 19:
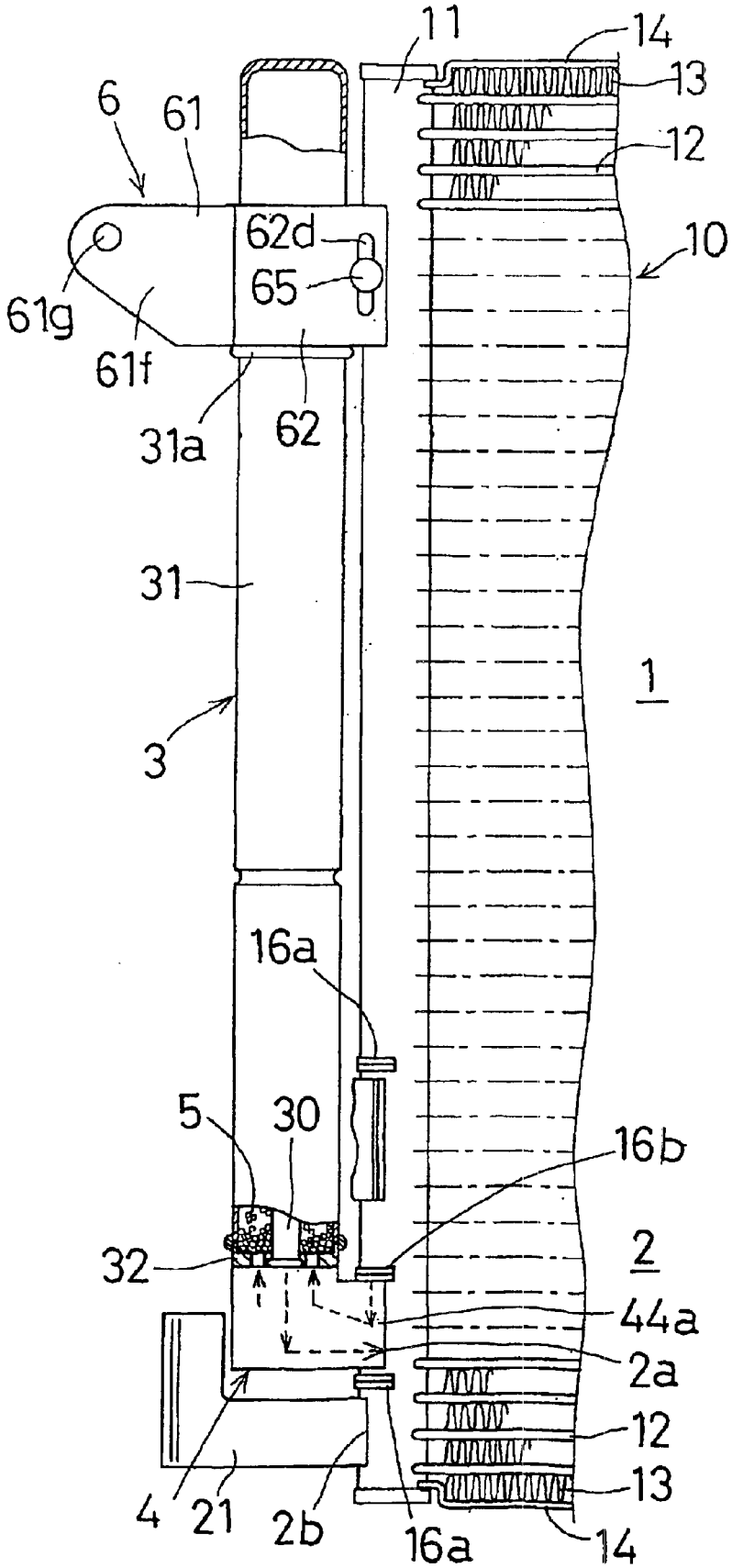
FIG. 19 is a front view showing one side portion of a heat exchanger with a receiver tank according to the third embodiment of the present invention.

In this second embodiment, in order to attach the receiver tank 3 to the block flange 4, first, as shown in FIG. 15, the convex stepped portions 35 and 36 of the receiver tank 3 are inserted into the concave stepped portions 45 and 46 of the block flange 4 with the pull-out-preventing projections 37 inserted into the projection introducing notches 47*a* until the pull-out-preventing projections 37 reach the lower end position of the projection introducing notches 47*a*, i.e., the position corresponding to the projection engaging slot 47*b*. In this state, as shown in FIG. 16, the pull-out-preventing projections 37 are inserted into the projection engaging slot 47*b* by slightly rotating the receiver tank 3 about the axis thereof. Thus, the pull-out-preventing projections 37 are engaged with the projection engaging slot 47*b*, to thereby prevent the block flange 4 from being upwardly pulled out from the receiver tank 3.

Since the other structures are the same as those of the first embodiment, the same or corresponding reference numeral will be allotted to the same or corresponding portion, and the duplicate explanation will be omitted.

According to this second embodiment, the same effects as those of the first embodiment can be obtained. Furthermore, since the receiver tank 3 is attached to the block flange 4 in a state that the receiver tank 3 is prevented from being pulled out, the receiver tank 3 can be connected to the block flange 4 more assuredly.

In the second embodiment, although the pull-out-preventing projections 37 formed at the outlet convex stepped portion 36 of the receiver tank 3 are engaged with the projection engaging slot 47*b* of the outlet concave stepped portion 46 of the block flange 4 by rotating the receiver tank 3, the present invention is not limited to the above. In the present invention, for example, the receiver tank may be attached to the block flange by engaging an external thread formed on the periphery of the outlet convex stepped portion 36 with an internal thread formed on the inner periphery of the concave stepped portion 46.

<Third Embodiment>

FIGS. 19 to 22 show a heat exchanger with a receiver tank according to the third embodiment of the present invention.

As shown in these figures, like the aforementioned embodiment, this heat exchanger is provided with a multi-flow type heat exchanger body 10, a receiver tank 3 and a block flange 4 as a joint member for connecting the receiver tank 3 to the heat exchanger body 10.

In this heat exchanger body 10, an opening 1*b* is formed in the end portion of the partition 16*b* that divides the heat exchanger body 10 into the condensing portion 1 and the subcooling portion 2, and this opening 1*b* constitutes the condensing portion outlet 1*b*. The other structures are the same as those of the aforementioned embodiments.

Furthermore, the receiver tank 3 is also provided with the same structure as that of the aforementioned embodiment.

As for the block flange 4, on the upper surface of the block flange 4 at the side of the receiver tank 3, an inlet concave stepped portion 45 having a round shape in horizontal cross-section capable of fitting the inlet convex stepped portion 35 of the aforementioned receiver tank 3 is formed. Furthermore, in the bottom surface of the inlet concave stepped portion 45, an outlet concave stepped portion 46 having a round shape in horizontal cross-section capable of fitting the outlet convex stepped portion 36 of the receiver tank 3 is formed.

Furthermore, at the header-side portion of the block flange 4, an embedding portion 44 is formed.

In this block flange 4, an inlet flow passage 4*a* for communicating the condensing portion 1 with the receiver tank 3 and an outlet flow passage 4*b* for communicating the receiver tank 3 with the subcooling portions 3 are formed.

The inlet flow passage 4*a* has one end (inlet side end portion) opened to the upper surface of the embedding portion 44, an intermediate portion which extends vertically downwardly and then extends obliquely upwardly and the other end (outlet side end portion) opened to the inner lower end of the periphery of the inlet concave stepped portion 45.

The outlet flow passage 4*b* has one end (inlet side end portion) opened to the bottom surface of the outlet concave stepped portion 46, an intermediate portion extending horizontally and the other end (outlet side end portion) opened to the side surface of the embedding portion 44.

This embedding portion 44 of the block flange 4 is inserted into the header 11 from the side of the header and embedded therein so as to be located under the partition 16*b*, and the flange members 44*a* formed at both sides of the embedding portion 44 is air-tightly secured to the header 11. In this state, the upper surface of the embedding portion 44 is air-tightly secured to the circumference of the condensing portion outlet 1*b* of the partition 16*b*, and the inlet side end portion of the inlet flow passage 4*a* opened to the upper surface of the embedding portion 44 is communicated with the condensing portion outlet 1*b*. Furthermore, the outlet side end portion of the outlet flow passage 4*b* opened to the side surface of the embedding portion 44 is communicated with the inside space of the header at the position corresponding to the subcooling portion 2, and the outlet side end portion of this outlet flow passage 4*b* is constituted as a subcooling portion inlet 2*a*.

In this embodiment, the outlet side end portion of the inlet flow passage 4*a* is positioned at the height corresponding to the upper part of the subcooling portion 2 and lower than the condensing portion outlet 1*b*.

Figure 20:
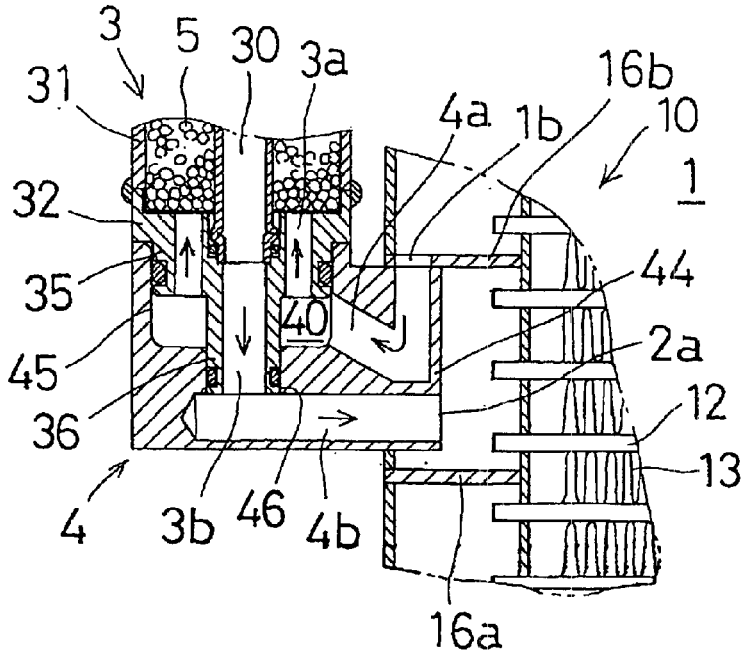
FIG. 20 is an enlarged cross-sectional view showing the block flange of the heat exchanger and therearound according to the third embodiment.
Figure 21:
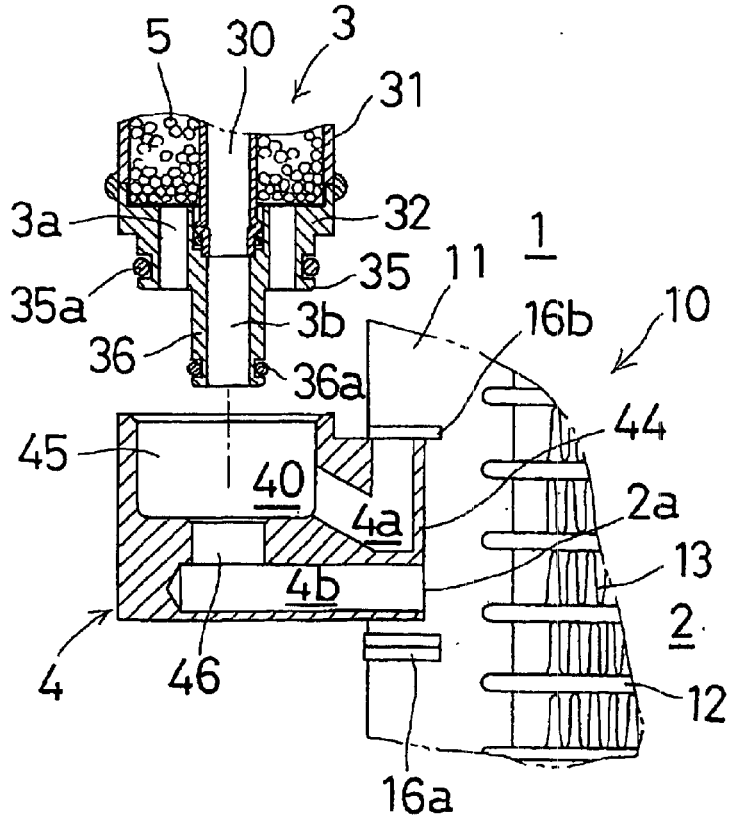
FIG. 21 is a cross-sectional view showing the block flange of the third embodiment in a disassembled state.
Figure 22:
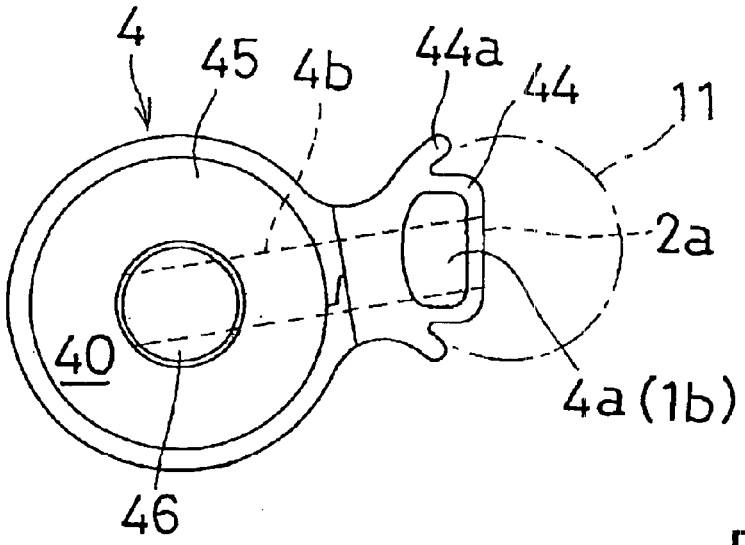
FIG. 22 is a plane view showing the block flange of the third embodiment.

As shown in FIGS. 20 and 21, like the first embodiment, the inlet-and-outlet concave stepped portions 45 and 46 of this block flange 4 is fitted into the inlet-and-outlet convex stepped portions 35 and 36 of the receiver tank 3, and that the upper part of the receiver tank 3 is fixed to one of the headers 11 with the same bracket 6 as aforementioned above.

Since the other structures are the same as those of the first embodiment, the same reference numeral is allotted to the same part, and the duplicate explanation will be omitted.

As mentioned above, in the heat exchanger with a receiver tank according to this embodiment, the same effects as those of the aforementioned embodiments can be obtained.

Furthermore, in this embodiment, since a part (embedding portion 44) of the block flange 4 is disposed in the header 11 in an embedded state, the occupancy space of the embedding portion 44 can be omitted, and therefore the miniaturization can be attained.

Furthermore, by arranging a part of the block flange 4 into the header 11 in an embedded state, the receiver tank 3 to be joined to the block flange 4 can be approached toward one of the headers 11. Accordingly, the entire heat exchanger can be further miniaturized.

Figure 23:
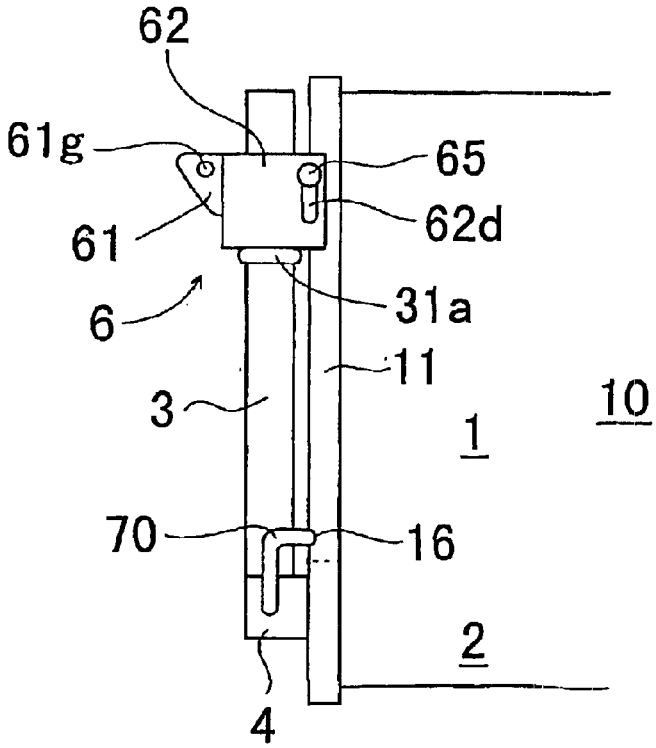
FIG. 23 is a front view showing one side portion of the heat exchanger with a receiver tank according to the third modification of the present invention.

Although the inlet flow passage 4*a* for communicating the condensing portion outlet 1*b* with the receiver tank inlet 3*a* is formed within the block flange 4, the present invention is not limited to this. As shown in FIG. 23, a piping 70 constituting a part of or the entire inlet flow passage may be attached externally. That is, the inlet side end portion of the inlet flow passage pipe 70 is connected to the condensing portion outlet 1*b* of the heat exchanger body 10, while the outlet side end portion thereof is connected to the block flange 4. Then, the refrigerant flowed out of the condensing portion outlet 1*b* is introduced into the inlet flow passage in the block flange 4 through the inlet flow passage pipe 70, and then introduced into the receiver tank 3. In this case, as shown in this FIG. 23, by setting the outlet side end portion (block flange side end portion) of the inlet flow passage pipe 70 to a position lower than the inlet side end portion (header side end portion), the entire receiver tank can be arranged at a lower position. Thus, the aforementioned effects due to this structure, for example, decreasing the size and weight, enhancing the performance, etc., can be attained more assuredly.

Furthermore, in the aforementioned embodiment, although the inlet-and-outlet forming member is formed separately from the tank main body, the present invention is not limited to this. The present invention may be applied to the inlet-and-outlet forming member integrally formed to the tank main body.

Furthermore, in the aforementioned embodiment, the present invention is applied to the so-called subcool system condenser, i.e., a heat exchanger with a receiver tank in which a subcooling portion is formed in a heat exchanger body. However, the present invention is not limited to this. The present invention can also be applied to a heat exchanger with a receiver tank in which a subcooling portion is not formed in a heat exchanger body.

Furthermore, in the aforementioned embodiment, the pressing stepped portion on the periphery of the tank main body periphery is formed by a ridge portion continuously extending in the circumferential direction thereof. However, the present invention is not limited to this. In the present invention, for example, a concave groove (pressing stepped portion) may be formed on the periphery of the tank main body, and a bracket may be fitted in the groove.

Furthermore, although the pressing stepped portion is formed on the periphery of the tank main body so as to continuously extend in the circumferential direction thereof, the present invention is not limited to this. One or a plurality of protruded portions may constitute the pressing stepped portion.

Furthermore, in the present invention, an inlet-and-outlet forming member may be integrally formed to the heat exchanger.

Furthermore, needless to say, the number of pass in the heat exchanger body or the number of heat exchanging tubes of each pass is not limited to the aforementioned embodiment.

As mentioned above, according to the heat exchanger with a receiver tank of the first aspect of the present invention, the lower end of the receiver tank can be connected to the joint member assuredly and that it is not required to increase the thickness of the lower wall of the receiver tank bottom wall so that the lower wall can be secured to the joint member by screws. Thus, it becomes possible to decrease the size and the weight and increase the tank volume. Accordingly, the stability range in the subcooling state of the refrigerant can be enlarged, and the excess of the sealed amount of refrigerant and the shortage thereof can be prevented. Thus, the amount of refrigerant can be optimized, resulting in stable refrigeration performance. Furthermore, since the screw tightening operation for securing the receiver tank to the joint member can be is omitted, the assembly operation of the receiver tank can be performed easily.

According to the heat exchanger with a receiver tank of the second or third aspect of the present invention, in addition to the effects according to the first aspect, the receiver tank can be connected to the joint member correctly and simply by simply fitting the convex stepped portion for inlet-and-outlet formed at the receiver-tank lower end into the concave stepped portion for inlet-and-outlet formed on the upper surface of the joint member. Accordingly, the receiver tank can be attached to the joint member simply and correctly.

According to the heat exchanger with a receiver tank of the fourth or fifth aspect of the present invention, in addition to the effects according to the first aspect, the mounting position of the receiver tank can be arranged at a lower position as a whole. Thus, a longer receiver tank can be employed, which in turn secures enough tank volume. Accordingly, the stability range in the subcooling state of the refrigerant can be enlarged, it becomes possible to prevent the excess of the sealed amount of refrigerant and the shortage of thereof, and the sealed amount of refrigerant can be optimized. Accordingly, a stable refrigeration performance can be obtained. Furthermore, since a longer tank can be used as a receiver tank, it is possible to use a tank having a smaller diameter while securing enough tank volume. Furthermore, the size and weight can be decreased, which in turn can decrease the size of the entire refrigerant system.

According to the heat exchanger with a receiver tank of the sixth aspect of the present invention, in addition to the effects according to the first aspect, since the refrigerant flowed out through the inlet flow passage is stored in the liquid-stagnating portion to be decreased in the refrigerant flow velocity, and then introduced into the tank through the receiver tank inlet, bubbles can be extinguished smoothly and efficiently. Accordingly, it becomes possible to assuredly extract only the stable liquefied refrigerant, and the refrigeration cycle can be operated stably. Thus, stable refrigeration performance can be obtained assuredly. Furthermore, since the stable supply of the liquefied refrigerant can be performed due to the improved bubble extinguishing, the receiver tank can be reduced in size and weight.

According to the heat exchanger with a receiver tank of the seventh aspect of the present invention, in addition to the effects according to the first aspect, since the refrigerant is introduced into the receiver tank through the receiver tank inlet having a large diameter at a reduced flow velocity, it is possible to extinguish the bubbles of refrigerant smoothly and efficiently. Therefore, in the receiver tank, only the stable liquefied refrigerant can be extracted assuredly. Thus, the refrigeration cycle can be operated stably, and the stable refrigeration performance can be obtained more assuredly. Furthermore, since the stable supply of liquefied refrigerant can be attained due to the improved bubble extinguish performance, it is possible to reduce the size and weight, which in turn can reduce the size and weight of the entire refrigeration system.

Since the eighth ($8^{th}$) to the fourteenth ($14^{th}$) aspect of the present invention specify the refrigeration system using the heat exchanger with a receiver tank according to the first ($1^{th}$) to the seventh ($7^{th}$) aspect of the present invention, the same effects as mentioned above can be obtained.

This application claims priority to Japanese Patent Applications Nos. 2001-57829, 2001-57831, 2001-57849 and 2001-57852 each filed on Mar. 2, 2001 and U.S. Provisional Applications Nos. 60/302,646, 60/302,657, 60/302,690 and 60/302,708 each filed on Jul. 5, 2001, and the disclosure of which is incorporated by reference in its entirety.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

Industrial Applicability

The heat exchanger with a receiver tank and the refrigeration system according to the present invention can be suitably used for, e.g., automobile air-conditioning refrigeration systems.

What is claimed is:

1. A heat exchanger with a receiver tank, comprising:

a heat exchanger body including a pair of headers, a plurality of heat exchanging tubes disposed in parallel with each other between said pair of headers with opposite ends of said heat exchanging tube communicated with said headers and a condensing portion constituted by said heat exchanging tubes, wherein a refrigerant condensed by said condensing portion is made to flow out of a condensing portion outlet of one of said headers;

a slender receiver tank disposed along said one of headers, said receiver tank having a tank main body, a receiver tank inlet and a receiver tank outlet each communicated with an inside of said tank main body;

a joint member joined to said condensing portion outlet of said one of headers and therearound, said joint member having an upper surface on which a lower end of said receiver tank is assembled; and a bracket for supporting said receiver tank to said one of said headers, wherein said joint member is provided with an inlet flow passage having one end communicated with said condensing portion outlet and the other end communicated with said receiver tank inlet and an outlet flow passage having one end communicated with said receiver tank outlet, wherein said receiver tank has a pressing stepped portion formed on a periphery of said tank main body, and wherein said bracket is provided with a joint portion joined to a periphery of said one of headers and an embracing portion which surrounds said periphery of said tank main body and engages with said pressing stepped portion to downwardly press said receiver tank.

2. The heat exchanger with a receiver tank as recited in claim 1, wherein said pressing stepped portion is constituted by a ridge portion formed on a periphery of said tank main body, said ridge portion continuously extending in a circumferential direction of said tank main body.

3. The heat exchanger with a receiver tank as recited in claim 1, wherein an inside of said pair of headers is divided, so that said plurality of said heat exchanging tubes are grouped into said condensing portion and a subcooling portion for subcooling a liquefied refrigerant, wherein said one of headers is provided with a subcooling portion inlet communicated with said subcooling portion, and wherein the other end of said outlet flow passage in said joint member is communicated with said subcooling portion inlet.

4. The heat exchanger with a receiver tank as recited in claim 1, wherein desiccating agents are disposed at a lower portion in said tank main body, wherein said receiver tank inlet is formed at a bottom surface of said tank main body, and wherein a lower end of a refrigerant inflow pipe disposed in said tank main body is communicated with said receiver tank outlet, while an upper end thereof is opened above said desiccating agents.

5. The heat exchanger with a receiver tank as recited in claim 1, wherein said bracket includes a bracket main body and a one side embracing member which is a member separated from said bracket main body, wherein said embracing portion is constituted by one side embracing portion provided at said bracket main body and disposed along one side half periphery of said tank main body and the other side embracing portion provided at said one side embracing member and disposed along the other side half periphery of said tank main body, wherein said joint portion is constituted by an end portion of said bracket main body.

6. The heat exchanger with a receiver tank as recited in claim 5, wherein said one side embracing member is provided with a vertically extended screw insertion slot at one end thereof, wherein a screw inserted in said screw insertion slot is screwed into said bracket main body in a state that an entire periphery of said tank main body is surrounded by said one side embracing portion and said the other side embracing portion, whereby said one side embracing member is fixed to said bracket main body.

7. The heat exchanger with a receiver tank as recited in claim 6, wherein said one side embracing member is attached to said bracket main body in a vertically slidable manner at the other end thereof.

8. The heat exchanger with a receiver tank as recited in claim 7, wherein said one side embracing member is provided with a vertically extended axial portion at the other end thereof, and wherein said bracket main body is provided with an axial portion holding groove accommodating said axial portion in such a manner that said axial portion is slidable vertically and rotatable around said axial portion.

9. The heat exchanger with a receiver tank as recited in claim 6, wherein said bracket main body is provided with a screw hole for securing said screw therein, and wherein said screw is secured in said screw hole.

10. The heat exchanger with a receiver tank as recited in claim 5, wherein said one side embracing member is provided with a first screw insertion hole and a second screw insertion hole at one end thereof, wherein a first screw and a second screw inserted in said first screw insertion hole and said second screw insertion hole respectively are screwed into said bracket main body in a state that an entire periphery of said tank main body is surrounded by said one side embracing portion and said the other side embracing portion, whereby said one side embracing member is fixed to said bracket main body.

11. The heat exchanger with a receiver tank as recited in claim 10, wherein said second screw insertion hole is a vertically extended slot.

12. The heat exchanger with a receiver tank as recited in claim 11, wherein said one side embracing member is attached to said bracket main body in a vertically slidable manner at the other end thereof.

13. The heat exchanger with a receiver tank as recited in claim 11, wherein said bracket main body is provided with a first screw hole and a second screw hole for securing said first screw and said second screw therein, and wherein said second screw is secured in said second screw hole.

14. The heat exchanger with a receiver tank as recited in claim 13, wherein said second screw is a synthetic resin molded article having an axial portion to be inserted in said second screw hole and a pull-out-preventing portion provided at a periphery of a tip portion of said axial portion, said pull-out-preventing portion being capable of elastically shrinking.

15. A heat exchanger with a receiver tank, comprising:

a heat exchanger body including a pair of headers, a plurality of heat exchanging tubes disposed in parallel with each other between said pair of headers with opposite ends of said heat exchanging tube communicated with said headers and a condensing portion constituted by said heat exchanging tubes, wherein said heat exchanger body flows out condensed refrigerant condensed by said condensing portion of a condensing portion outlet of one of said headers;

a slender receiver tank disposed along said one of headers, said receiver tank having a tank main body, a receiver tank inlet and a receiver tank outlet each communicated with an inside of said tank main body;

a joint member joined to said condensing portion outlet of said one of headers and therearound, said joint member having an upper surface on which a lower end of said receiver tank is assembled; and a bracket for supporting said receiver tank to said one of said headers, wherein said joint member is provided with an inlet flow passage having one end communicated with said condensing portion outlet and the other end communicated with said receiver tank inlet and an outlet flow passage having one end communicated with said receiver tank outlet, wherein said receiver tank has a pressing stepped portion formed on a periphery of said tank main body, wherein said bracket is provided with a joint portion joined to said periphery of said one of headers and an embracing portion which surrounds said periphery of said tank main body and engages with said pressing stepped portion to downwardly press said receiver tank, wherein said receiver tank is provided with a downwardly protruded convex stepped portion at a lower surface of said receiver tank, while said joint member is provided with a concave stepped portion at an upper surface of said joint member, and wherein said receiver tank is assembled to said joint member in a state that said convex stepped portion is fitted in said concave stepped portion.

16. The heat exchanger with a receiver tank as recited in claim 15, wherein said pressing stepped portion is constituted by a ridge portion formed on a periphery of said tank main body, said ridge portion continuously extending in a circumferential direction of said tank main body.

17. The heat exchanger with a receiver tank as recited in claim 15, wherein an inside of said pair of headers is divided, so that said plurality of said heat exchanging tubes are grouped into said condensing portion and a subcooling portion for subcooling a liquefied refrigerant, wherein said one of headers is provided with a subcooling portion inlet communicated with said subcooling portion, and wherein the other end of said outlet flow passage in said joint member is communicated with said subcooling portion inlet.

18. The heat exchanger with a receiver tank as recited in claim 15, wherein desiccating agents are disposed at a lower portion in said tank main body, wherein said receiver tank inlet is formed at a bottom surface of said tank main body, and wherein a lower end of a refrigerant inflow pipe disposed in said tank main body is communicated with said receiver tank outlet, while an upper end thereof is opened above said desiccating agents.

19. A heat exchanger with a receiver tank, comprising:

a heat exchanger body including a pair of headers, a plurality of heat exchanging tubes disposed in parallel with each other between said pair of headers with opposite ends of said heat exchanging tube communicated with said headers and a condensing portion constituted by said heat exchanging tubes, wherein a refrigerant condensed by said condensing portion is made to flow out of a condensing portion outlet of one of said headers;

a slender receiver tank disposed along said one of headers, said receiver tank having a tank main body with a pressing stepped portion on a peripheral surface of said tank main body, and an inlet-and-outlet portion formed on a lower end of said tank main body;

a joint member joined to said condensing portion outlet of said one of headers and therearound, said joint member having an upper surface on which said inlet-and-outlet portion of said receiver tank is assembled; and a bracket for supporting said receiver tank to said one of said headers, wherein said joint member is provided with an inlet concave stepped portion formed on an upper surface thereof, an outlet concave stepped portion formed in a bottom surface of said inlet concave stepped portion, an inlet flow passage having one end opened to a joining surface of said one of headers and communicated with said condensing portion outlet and the other end opened to said inlet concave stepped portion, and an outlet flow passage having one end opened to said outlet concave stepped portion, wherein said inlet-and-outlet portion is provided with a downwardly protruded inlet convex stepped portion formed on a lower surface thereof, a downwardly protruded outlet convex stepped portion formed on a lower end surface of said inlet convex stepped portion, a receiver tank inlet formed in said inlet convex stepped portion and communicated with an inside of said tank main body, and a receiver tank outlet formed in said outlet convex stepped portion and communicated with an inside of said tank main body, wherein said bracket is provided with a joint portion joined to said periphery of said one of headers and an embracing portion which surrounds said periphery of said tank main body and engages with said pressing stepped portion to downwardly press said receiver tank, and wherein said receiver tank is assembled to said joint member in a state that said inlet convex stepped portion and said outlet convex stepped portion are fitted in said inlet concave stepped portion and said outlet concave stepped portion, respectively, and that said receiver tank is downwardly pressed by said bracket.

20. The heat exchanger with a receiver tank as recited in claim 19, wherein said pressing stepped portion is constituted by a ridge portion formed on a periphery of said tank main body, said ridge portion continuously extending in a circumferential direction of said tank main body.

21. The heat exchanger with a receiver tank as recited in claim 19, wherein an inside of said pair of headers is divided, so that said plurality of said heat exchanging tubes are grouped into said condensing portion and a subcooling portion for subcooling a liquefied refrigerant, wherein said one of headers is provided with a subcooling portion inlet communicated with said subcooling portion, and wherein the other end of said outlet flow passage in said joint member is communicated with said subcooling portion inlet.

22. The heat exchanger with a receiver tank as recited in claims 19, wherein desiccating agents are disposed at a lower portion in said tank main body, wherein said receiver tank inlet is formed at a bottom surface of said tank main body, and wherein a lower end of a refrigerant inflow pipe disposed in said tank main body is communicated with said receiver tank outlet, while an upper end thereof is opened above said desiccating agents.

23. The heat exchanger with a receiver tank as recited in claim 19, wherein said inlet convex stepped portion and said outlet convex stepped portion are circular in cross-section, respectively, and wherein said inlet convex stepped portion and said outlet convex stepped portion are formed such that an axial center thereof coincides with an axial center of said receiver tank.

24. The heat exchanger with a receiver tank as recited in claim 23, wherein said outlet convex stepped portion is provided with a pull-out-preventing projection protruded sideways on a periphery of said outlet convex stepped portion, wherein said outlet concave stepped portion is provided with a projection introducing notch and a projection engaging slot at an inner periphery thereof, said projection introducing notch having an upper end opened to a periphery of said outlet concave stepped portion in said inlet concave stepped portion and extending downwardly along an axis thereof, and said projection engaging slot having one end communicated with a lower end of said projection introducing notch and extending in a circumferential direction along an inner periphery of said outlet concave stepped portion, wherein said receiver tank is rotated about an axial center thereof in a state that said outlet convex stepped portion is fitted in said outlet concave stepped portion with said pull-out-preventing projection inserted in said projection introducing notch, whereby said receiver tank is secured to said joint member with said pull-out-preventing projection engaged with said projection engaging slot.

25. A heat exchanger with a receiver tank, comprising:

a heat exchanger body including a pair of vertical headers, a plurality of heat exchanging tubes disposed in parallel with each other between said pair of headers with opposite ends of said heat exchanging tube communicated with said headers and a partition provided in said header to group said plurality of heat exchanging tubes into an upper condensing portion and a lower subcooling portion, wherein a condensing portion outlet is provided at a position corresponding to a lower end of said condensing portion of said one of headers for flowing out a refrigerant from said condensing portion, and a subcooling portion inlet is provided at a position corresponding to said subcooling portion of said one of headers for introducing the refrigerant into said subcooling portion;

a slender receiver tank disposed along said one of headers, said receiver tank having a tank main body, a receiver tank inlet and a receiver tank outlet formed at a lower end of said tank main body and communicated with an inside of said tank main body;

a joint member joined to a region including said condensing portion outlet and said subcooling inlet of said one of headers, said joint member having an upper surface on which a lower end of said receiver tank is assembled; and a bracket for supporting said receiver tank to said one of said headers, wherein said joint member is provided with an inlet flow passage having an inlet side end portion communicated with said condensing portion outlet and an outlet side end portion communicated with said receiver tank inlet and an outlet flow passage having an inlet side end portion communicated with said receiver tank outlet and an outlet side end portion communicated with said subcooling portion inlet, wherein said receiver tank has a pressing stepped portion formed on a periphery of said tank main body, wherein said bracket is provided with a joint portion joined to said periphery of said one of headers and an embracing portion which surrounds said periphery of said tank main body and engages with said pressing stepped portion to downwardly press said receiver tank, and wherein a part of said inlet flow passage extends downward so that an outlet side end portion of said inlet flow passage is arranged at a position lower than a position of said condensing portion outlet.

26. The heat exchanger with a receiver tank as recited in claim 25, wherein said pressing stepped portion is constituted by a ridge portion formed on a periphery of said tank main body, said ridge portion continuously extending in a circumferential direction of said tank main body.

27. The heat exchanger with a receiver tank as recited in claim 25, wherein desiccating agents are disposed at a lower portion in said tank main body, wherein said receiver tank inlet is formed at a bottom surface of said tank main body, and wherein a lower end of a refrigerant inflow pipe disposed in said tank main body is communicated with said receiver tank outlet, while an upper end thereof is opened above said desiccating agents.

28. The heat exchanger with a receiver tank as recited in claim 25, wherein an outlet side end portion of said inlet flow passage in said joint member is arranged at a position corresponding to said subcooling portion.

29. The heat exchanger with a receiver tank as recited in claim 25, wherein said partition provided between said condensing portion and said subcooling portion in said one of headers is provided with an opening constituting said condensing portion outlet, wherein one side portion of said joint member is arranged in said one of headers so as to be located under a lower surface of said partition, wherein an inlet side end portion of said inlet flow passage is opened to an upper surface of said one side portion of said joint member and communicated with said condensing portion outlet, and wherein an outlet side end portion of said outlet flow passage is opened to an inside of said one of headers at a position lower than said partition.

30. A heat exchanger with a receiver tank, comprising:

a heat exchanger body including a pair of vertical headers, a plurality of heat exchanging tubes disposed in parallel with each other between said pair of headers with opposite ends of said heat exchanging tube communicated with said headers and a partition provided in said header to group said plurality of heat exchanging tubes into an upper condensing portion and a lower subcooling portion, wherein a condensing portion outlet for flowing out a refrigerant from said condensing portion is provided at a position corresponding to a lower end of said condensing portion of said one of headers, and a subcooling portion inlet for introducing the refrigerant into said subcooling portion is provided at a position corresponding to said subcooling portion of said one of headers;

a slender receiver tank disposed along said one of headers, said receiver tank having a tank main body, a receiver tank inlet and a receiver tank outlet each formed at a lower end of said tank main body and each communicated with an inside of said tank main body;

a joint member joined to said one of headers, said joint member having an upper surface on which a lower end of said receiver tank is assembled;

an inlet flow passage pipe having an inlet side end portion communicated with said condensing portion outlet and an outlet side end portion communicated with said receiver tank inlet; and a bracket for supporting said receiver tank to said one of said headers, wherein said joint member is provided with an outlet flow passage having an inlet side end portion communicated with said receiver tank outlet and an outlet side end portion communicated with said subcooling portion inlet, wherein said receiver tank has a pressing stepped portion formed on a periphery of said tank main body, wherein said bracket is provided with a joint portion joined to said periphery of said one of headers and an embracing portion which surrounds said periphery of said tank main body and engages with said pressing stepped portion to downwardly press said receiver tank, and wherein a part of said inlet flow passage pipe extends downward so that an outlet side end portion of said inlet flow passage pipe is arranged at a position lower than a position of said condensing portion outlet.

31. The heat exchanger with a receiver tank as recited in claim 30, wherein said outlet side end portion of said inlet flow passage pipe is arranged at a height position corresponding to said subcooling portion.

32. A heat exchanger with a receiver tank, comprising:

a heat exchanger body including a pair of headers, a plurality of heat exchanging tubes disposed in parallel with each other between said pair of headers with opposite ends of said heat exchanging tube communicated with said headers and a condensing portion constituted by said heat exchanging tubes, wherein a refrigerant condensed by said condensing portion is made to flow out of a condensing portion outlet of one of said headers;

a slender receiver tank disposed along said one of headers, said receiver tank having a tank main body, a receiver tank inlet and a receiver tank outlet formed at a lower end of said tank main body and communicated with an inside of said tank main body;

a joint member joined to said condensing portion outlet of said one of headers, said joint member having an upper surface on which a lower end of said receiver tank is assembled; and a bracket for supporting said receiver tank to said one of said headers, wherein said joint member is provided with an inlet flow passage having an inlet side end portion communicated with said condensing portion outlet and an outlet side end portion communicated with a receiver tank inlet and an outlet flow passage having an outlet side end portion communicated with said receiver tank outlet, wherein said receiver tank has a pressing stepped portion formed on a periphery of said tank main body, wherein said bracket is provided with a joint portion joined to said periphery of said one of headers and an embracing portion which surrounds said periphery of said tank main body and engages with said pressing stepped portion to downwardly press said receiver tank, and wherein a liquid-stagnating portion for storing a refrigerant is formed between said outlet side end portion of said inlet flow passage in said joint member and said receiver tank inlet.

33. The heat exchanger with a receiver tank as recited in claim 32, wherein said pressing stepped portion is constituted by a ridge portion formed on a periphery of said tank main body, said ridge portion continuously extending in a circumferential direction of said tank main body.

34. The heat exchanger with a receiver tank as recited in claim 32, wherein an inside of said pair of headers is divided, so that said plurality of said heat exchanging tubes are grouped into said condensing portion and a subcooling portion for subcooling a liquefied refrigerant, wherein said one of headers is provided with a subcooling portion inlet communicated with said subcooling portion, and wherein an outlet side end portion of said outlet flow passage in said joint member is communicated with said subcooling portion inlet.

35. The heat exchanger with a receiver tank as recited in claim 32, wherein desiccating agents are disposed at a lower portion in said tank main body, wherein said receiver tank inlet is formed at a bottom surface of said tank main body, and wherein a lower end of a refrigerant inflow pipe disposed in said tank main body is communicated with said receiver tank outlet, while an upper end thereof is opened above said desiccating agents.

36. The heat exchanger with a receiver tank as recited in claim 32, wherein said joint member is provided with an inlet concave stepped portion formed on an upper surface thereof and an outlet concave stepped portion formed in a bottom surface of said inlet concave stepped portion, an outlet side end portion of said inlet flow passage being opened to said inlet concave stepped portion, while an inlet side end portion of said outlet flow passage being opened to said outlet concave stepped portion, wherein said receiver tank has a downwardly protruded inlet convex stepped portion formed on a lower end thereof and a downwardly protruded outlet convex stepped portion formed on a lower end of said inlet convex stepped portion, said inlet convex stepped portion having said receiver tank inlet, said outlet convex stepped portion having said receiver tank outlet, wherein said inlet convex stepped portion and said outlet convex stepped portion are fitted in said inlet concave stepped portion and said outlet concave stepped portion, respectively, to thereby attach said receiver tank to said joint member, and wherein said liquid stagnating portion is constituted by a gap formed between a lower end surface of said inlet convex stepped portion and a bottom surface of said inlet concave stepped portion in a state that said receiver tank is attached to said joint member.

37. The heat exchanger with a receiver tank as recited in claim 36, wherein a plurality of said receiver tank inlets are formed in a periphery of said outlet convex stepped portion at regular intervals along a circumferential direction thereof.

38. A heat exchanger with a receiver tank, comprising:

a heat exchanger body including a pair of headers, a plurality of heat exchanging tubes disposed in parallel with each other between said pair of headers with opposite ends of said heat exchanging tube communicated with said headers and a condensing portion constituted by said heat exchanging tubes, wherein a refrigerant condensed by said condensing portion is made to flow out of a condensing portion outlet of one of said headers;

a slender receiver tank disposed along said one of headers, said receiver tank having a tank main body, a receiver tank inlet and a receiver tank outlet each formed at a lower end of said tank main body and each communicated with an inside of said tank main body;

a joint member joined to a condensing portion outlet of said one of headers and therearound, said joint member having an upper surface on which a lower end of said receiver tank is assembled; and a bracket for supporting said receiver tank to said one of said headers, wherein said joint member is provided with an inlet flow passage having an inlet side end communicated with said condensing portion outlet and an outlet side end communicated with said receiver tank inlet and an outlet flow passage having an inlet side end portion communicated with said receiver tank outlet, wherein said receiver tank has a pressing stepped portion formed on a periphery of said tank main body, wherein said bracket is provided with a joint portion joined to said periphery of said one of headers and an embracing portion which surrounds said periphery of said tank main body and engages with said pressing stepped portion to downwardly press said receiver tank, and wherein an opening area of said receiver tank inlet is formed to be larger than an opening area of said receiver tank outlet.

39. The heat exchanger with a receiver tank as recited in claim 38, wherein said pressing stepped portion is constituted by a ridge portion formed on a periphery of said tank main body, said ridge portion continuously extending in a circumferential direction of said tank main body.

40. The heat exchanger with a receiver tank as recited in claim 38, wherein an inside of said pair of headers is divided, so that said plurality of said heat exchanging tubes are grouped into said condensing portion and a subcooling portion for subcooling a liquefied refrigerant, wherein said one of headers is provided with a subcooling portion inlet communicated with said subcooling portion, and wherein an outlet side end portion of said outlet flow passage in said joint member is communicated with said subcooling portion inlet.

41. The heat exchanger with a receiver tank as recited in claim 38, wherein desiccating agents are disposed at a lower portion in said tank main body, wherein said receiver tank inlet is formed at a bottom surface of said tank main body, and wherein a lower end of a refrigerant inflow pipe disposed in said tank main body is communicated with said receiver tank outlet, while an upper end thereof is opened above said desiccating agents.

42. The heat exchanger with a receiver tank as recited in claim 38, wherein said joint member is provided with an inlet concave stepped portion formed on an upper surface thereof and an outlet concave stepped portion formed on a bottom surface of said inlet concave stepped portion, an outlet side end portion of said inlet flow passage being opened to said inlet concave stepped portion, while an inlet side end portion of said outlet flow passage being opened to said outlet concave stepped portion, wherein said receiver tank has a downwardly protruded inlet convex stepped portion formed on a lower end thereof and a downwardly protruded outlet convex stepped portion formed on a lower end of said inlet convex stepped portion, said inlet convex stepped portion having said receiver tank inlets on a periphery of said outlet convex stepped portion at certain intervals in a circumferential direction thereof, said outlet convex stepped portion having said receiver tank outlet, wherein said inlet convex stepped portion and said outlet convex stepped portion are fitted in said inlet concave stepped portion and said outlet concave stepped portion, respectively, to thereby attach said receiver-tank to said joint member.

43. A refrigeration system in which a refrigerant compressed by a compressor is condensed by a heat exchanger with a receiver tank, the condensed refrigerant is decompressed by passing through a decompressing device, and the decompressed refrigerant is evaporated by an evaporator and then returned to said compressor, said heat exchanger with a receiver tank, comprising:

a heat exchanger body including a pair of headers, a plurality of heat exchanging tubes disposed in parallel with each other between said pair of headers with opposite ends of said heat exchanging tube communicated with said headers and a condensing portion constituted by said heat exchanging tubes, wherein a refrigerant condensed by said condensing portion is made to flow out of a condensing portion outlet of one of said headers;

a slender receiver tank disposed along said one of headers, said receiver tank having a tank main body, a receiver tank inlet and a receive, tank outlet each communicated with an inside of said tank main body;

a joint member joined to said condensing portion outlet of said one of headers and therearound, said joint member having an upper surface on which a lower end of said receiver tank is assembled; and a bracket for supporting said receiver tank to said one of said headers, wherein said joint member is provided with an inlet flow passage having one end communicated with said condensing portion outlet and the other end communicated with said receiver tank inlet and an outlet flow passage having one end communicated with said receiver tank outlet, wherein said receiver tank has a pressing stepped portion formed on a periphery of said tank main body, and wherein said bracket is provided with a joint portion joined to said periphery of said one of headers and an embracing portion which surrounds said periphery of said tank main body and engages with said pressing stepped portion to downwardly press said receiver tank.

44. The refrigeration system as recited in claim 43, wherein an inside of said pair of headers is divided, so that said plurality of said heat exchanging tubes are grouped into said condensing portion and a subcooling portion for subcooling a liquefied refrigerant, wherein said one of headers is provided with a subcooling portion inlet communicated with said subcooling portion, and wherein the other end of said outlet flow passage in said joint member is communicated with said subcooling portion inlet.

45. A refrigeration system in which a refrigerant compressed by a compressor is condensed by a heat exchanger with a receiver tank, the condensed refrigerant is decompressed by passing through a decompressing device, and the decompressed refrigerant is evaporated by an evaporator and then returned to said compressor, said heat exchanger with a receiver tank, comprising:

a heat exchanger body including a pair of headers, a plurality of heat exchanging tubes disposed in parallel with each other between said pair of headers with opposite ends of said heat exchanging tube communicated with said headers and a condensing portion constituted by said heat exchanging tubes, wherein a refrigerant condensed by said condensing portion is made to flow out of a condensing portion outlet of one of said headers;

a slender receiver tank disposed along said one of headers, said receiver tank having a tank main body, a receiver tank inlet and a receiver tank outlet each communicated with an inside of said tank main body;

a joint member joined to said condensing portion outlet of said one of headers and therearound, said joint member having an upper surface on which a lower end of said receiver tank is assembled; and a bracket for supporting said receiver tank to said one of said headers, wherein said joint member is provided with an inlet flow passage having one end communicated with said condensing portion outlet and the other end communicated with said receiver tank inlet and an outlet flow passage having one end communicated with said receiver tank outlet, wherein said receiver tank has a pressing stepped portion formed on a periphery of said tank main body, wherein said bracket is provided with a joint portion joined to said periphery of said one of headers and an embracing portion which surrounds said periphery of said tank main body and engages with said pressing stepped portion to downwardly press said receiver tank, wherein said receiver tank is provided with a downwardly protruded convex stepped portion at a lower surface of said receiver tank, while said joint member is provided with a concave stepped portion at an upper surface of said joint member, and wherein said receiver tank is assembled to said joint member in a state that said convex stepped portion is fitted in said concave stepped portion.

46. The refrigeration system as recited in claim 45, wherein an inside of said pair of headers is divided, so that said plurality of said heat exchanging tubes are grouped into said condensing portion and a subcooling portion for subcooling a liquefied refrigerant, wherein said one of headers is provided with a subcooling portion inlet communicated with said subcooling portion, and wherein the other end of said outlet flow passage in said joint member is communicated with said subcooling portion inlet.

47. A refrigeration system in which a refrigerant compressed by a compressor is condensed by a heat exchanger with a receiver tank, the condensed refrigerant is decompressed by passing through a decompressing device, and the decompressed refrigerant is evaporated by an evaporator and then returned to said compressor, said heat exchanger with a receiver tank, comprising:

a heat exchanger body including a pair of headers, a plurality of heat exchanging tubes disposed in parallel with each other between said pair of headers with opposite ends of said heat exchanging tube communicated with said headers and a condensing portion constituted by said heat exchanging tubes, wherein a refrigerant condensed by said condensing portion is made to flow out of a condensing portion outlet of one of said headers;

a slender receiver tank disposed along said one of headers, said receiver tank having a tank main body with a pressing stepped portion on a peripheral surface of said tank main body, and an inlet-and-outlet portion formed on a lower end of said tank main body;

a joint member joined to said condensing portion outlet of said one of headers and therearound, said joint member having an upper surface on which said inlet-and-outlet portion of said receiver tank is assembled; and a bracket for supporting said receiver tank to said one of said headers, wherein said joint member is provided with an inlet concave stepped portion formed on an upper surface thereof, an outlet concave stepped portion formed in a bottom surface of said inlet concave stepped portion, an inlet flow passage having one end opened to a joining surface of said one of headers and communicated with said condensing portion outlet and the other end opened to said inlet concave stepped portion, and an outlet flow passage having one end opened to said outlet concave stepped portion, wherein said inlet-and-outlet portion is provided with a downwardly protruded inlet convex stepped portion formed on a lower surface thereof, a downwardly protruded outlet convex stepped portion formed on a lower end surface of said inlet convex stepped portion, a receiver tank inlet formed in said inlet convex stepped portion and communicated with an inside of said tank main body, and a receiver tank outlet formed in said outlet convex stepped portion and communicated with an inside of said tank main body, wherein said bracket is provided with a joint portion joined to said periphery of said one of headers and an embracing portion which surrounds said periphery of said tank main body and engages with said pressing stepped portion to downwardly press said receiver tank, and wherein said receiver tank is assembled to said joint member in a state that said inlet convex stepped portion and said outlet convex stepped portion are fitted in said inlet concave stepped portion and said outlet concave stepped portion, respectively, and that said receiver tank is downwardly pressed by said bracket.

48. The refrigeration system as recited in claim 47, wherein an inside of said pair of headers is divided, so that said plurality of said heat exchanging tubes are grouped into said condensing portion and a subcooling portion for subcooling a liquefied refrigerant, wherein said one of headers is provided with a subcooling portion inlet communicated with said subcooling portion, and wherein the other end of said outlet flow passage in said joint member is communicated with said subcooling portion inlet.

49. A refrigeration system in which a refrigerant compressed by a compressor is condensed by a heat exchanger with a receiver tank, the condensed refrigerant is decompressed by passing through a decompressing device, and the decompressed refrigerant is evaporated by an evaporator and then returned to said compressor, said heat exchanger with a receiver tank, comprising:

a heat exchanger body including a pair of vertical headers, a plurality of heat exchanging tubes disposed in parallel with each other between said pair of headers with opposite ends of said heat exchanging tube communicated with said headers and a partition provided in said header to group said plurality of heat exchanging tubes into an upper condensing portion and a lower subcooling portion, wherein a condensing portion outlet is provided at a position corresponding to a lower end of said condensing portion of said one of headers for flowing out a refrigerant from said condensing portion, and a subcooling portion inlet is provided at a position corresponding to said subcooling portion of said one of headers for introducing the refrigerant into said subcooling portion;

a slender receiver tank disposed along said one of headers, said receiver tank having a tank main body, a receiver tank inlet and a receiver tank outlet each formed at a lower end of said tank main body and each communicated with an inside of said tank main body;

a joint member joined to a region including said condensing portion outlet and said subcooling inlet of said one of headers, said joint member having an upper surface on which a lower end of said receiver tank is assembled; and a bracket for supporting said receiver tank to said one of said headers, wherein said joint member is provided with an inlet flow passage having an inlet side end portion communicated with said condensing portion outlet and an outlet side end portion communicated with said receiver tank inlet and an outlet flow passage having an inlet side end portion communicated with said receiver tank outlet and an outlet side end portion communicated with said subcooling portion inlet, wherein said receiver tank has a pressing stepped portion formed on a periphery of said tank main body, wherein said bracket is provided with a joint portion joined to said periphery of said one of headers and an embracing portion which surrounds said periphery of said tank main body and engages with said pressing stepped portion to downwardly press said receiver tank, and wherein a part of said inlet flow passage extends downward so that an outlet side end portion of said inlet flow passage is arranged at a position lower than a position of said condensing portion outlet.

50. A refrigeration system in which a refrigerant compressed by a compressor is condensed by a heat exchanger with a receiver tank, the condensed refrigerant is decompressed by passing through a decompressing device, and the decompressed refrigerant is evaporated by an evaporator and then returned to said compressor, said heat exchanger with a receiver tank, comprising:

a heat exchanger body including a pair of vertical headers, a plurality of heat exchanging tubes disposed in parallel with each other between said pair of headers with opposite ends of said heat exchanging tube communicated with said headers and a partition provided in said header to group said plurality of heat exchanging tubes into an upper condensing portion and a lower subcooling portion, wherein a condensing portion outlet for flowing out a refrigerant from said condensing portion is provided at a position corresponding to a lower end of said condensing portion of said one of headers, and a subcooling portion inlet for introducing the refrigerant into said subcooling portion is provided at a position corresponding to said subcooling portion of said one of headers;

a slender receiver tank disposed along said one of headers, said receiver tank having a tank main body, a receiver tank inlet and a receiver tank outlet formed at a lower end of said tank main body and communicated with an inside of said tank main body;

a joint member joined to said condensing portion outlet of said one of headers, said joint member having an upper surface on which a lower end of said receiver tank is assembled;

an inlet flow passage pipe having an inlet side end portion communicated with said condensing portion outlet and an outlet side end portion communicated with said receiver tank inlet; and a bracket for supporting said receiver tank to said one of said headers, wherein said joint member is provided with an outlet flow passage having an inlet side end portion communicated with said receiver tank outlet and an outlet side end portion communicated with said subcooling portion inlet, wherein said receiver tank has a pressing stepped portion formed on a periphery of said tank main body, wherein said bracket is provided with a joint portion joined to said periphery of said one of headers and an embracing portion which surrounds said periphery of said tank main body and engages with said pressing stepped portion to downwardly press said receiver tank, and wherein a part of said inlet flow passage pipe extends downward so that an outlet side end portion of said inlet flow passage pipe is arranged at a position lower than a position of said condensing portion outlet.

51. A refrigeration system in which a refrigerant compressed by a compressor is condensed by a heat exchanger with a receiver tank, the condensed refrigerant is decompressed by passing through a decompressing device, and the decompressed refrigerant is evaporated by an evaporator and then returned to said compressor, said heat exchanger with a receiver tank, comprising:

a heat exchanger body including a pair of headers, a plurality of heat exchanging tubes disposed in parallel with each other between said pair of headers with opposite ends of said heat exchanging tube communicated with said headers and a condensing portion constituted by said heat exchanging tubes, wherein a refrigerant condensed by said condensing portion is made to flow out of a condensing portion outlet of one of said headers;

a slender receiver tank disposed along said one of headers, said receiver tank having a tank main body, a receiver tank inlet and a receiver tank outlet formed at a lower end of said tank main body and communicated with an inside of said tank main body;

a joint member joined to said one of headers, said joint member having an upper surface on which a lower end of said receiver tank is assembled; and a bracket for supporting said receiver tank to said one of said headers, wherein said joint member is provided with an inlet flow passage having an inlet side end portion communicated with said condensing portion outlet and an outlet side end portion communicated with an receiver tank inlet and an outlet flow passage having an outlet side end portion communicated with said receiver tank outlet, wherein said receiver tank has a pressing stepped portion formed on a periphery of said tank main body, wherein said bracket is provided with a joint portion joined to said periphery of said one of headers and an embracing portion which surrounds said periphery of said tank main body and engages with said pressing stepped portion to downwardly press said receiver tank, and wherein a liquid-stagnating portion for storing a refrigerant is formed between said outlet side end portion of said inlet flow passage in said joint member and said receiver tank inlet.

52. The refrigeration system as recited in claim 51, wherein an inside of said pair of headers is divided, so that said plurality of said heat exchanging tubes are grouped into said condensing portion and a subcooling portion for subcooling a liquefied refrigerant, wherein said one of headers is provided with a subcooling portion inlet communicated with said subcooling portion, and wherein an outlet side end portion of said outlet flow passage in said joint member is communicated with said subcooling portion inlet.

53. A refrigeration system in which a refrigerant compressed by a compressor is condensed by a heat exchanger with a receiver tank, the condensed refrigerant is decompressed by passing through a decompressing device, and the decompressed refrigerant is evaporated by an evaporator and then returned to said compressor, said heat exchanger with a receiver tank, comprising:

a heat exchanger body including a pair of headers, a plurality of heat exchanging tubes disposed in parallel with each other between said pair of headers with opposite ends of said heat exchanging tube communicated with said headers and a condensing portion constituted by said heat exchanging tubes, wherein a refrigerant condensed by said condensing portion is made to flow out of a condensing portion outlet of one of said headers;

a slender receiver tank disposed along said one of headers, said receiver tank having a tank main body, a receiver tank inlet and a receiver tank outlet each formed at a lower end of said tank main body and each communicated with an inside of said tank main body;

a joint member joined to a condensing portion outlet of said one of headers and therearound, said joint member having an upper surface on which a lower end of said receiver tank is assembled; and a bracket for supporting said receiver tank to said one of said headers, wherein said joint member is provided with an inlet flow passage having an inlet side end communicated with said condensing portion outlet and an outlet side end communicated with said receiver tank inlet and an outlet flow passage having an inlet side end portion communicated with said receiver tank outlet, wherein said receiver tank has a pressing stepped portion formed on a periphery of said tank main body, wherein said bracket is provided with a joint portion joined to said periphery of said one of headers and an embracing portion which surrounds said periphery of said tank main body and engages with said pressing stepped portion to downwardly press said receiver tank, and wherein an opening area of said receiver tank inlet is formed to be larger than an opening area of said receiver tank outlet.

54. The refrigeration system as recited in claim 53, wherein an inside of said pair of headers is divided, so that said plurality of said heat exchanging tubes are grouped into said condensing portion and a subcooling portion for subcooling a liquefied refrigerant, wherein said one of headers is provided with a subcooling portion inlet communicated with said subcooling portion, and wherein an outlet side end portion of said outlet flow passage in said joint member is communicated with said subcooling portion inlet.

* * * * *